US008141998B2

(12) United States Patent
Nozawa et al.

(10) Patent No.: US 8,141,998 B2
(45) Date of Patent: Mar. 27, 2012

(54) LIQUID CONTAINER

(75) Inventors: Izumi Nozawa, Matsumoto (JP); Hitotoshi Kimura, Matsumoto (JP); Kazutoshi Shimizu, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 635 days.

(21) Appl. No.: 11/935,647

(22) Filed: Nov. 6, 2007

(65) Prior Publication Data

US 2008/0136878 A1 Jun. 12, 2008

(30) Foreign Application Priority Data

Nov. 6, 2006 (JP) ..... 2006-300935
Mar. 30, 2007 (JP) ..... 2007-094151
Sep. 14, 2007 (JP) ..... 2007-240195

(51) Int. Cl.
*B41J 2/175* (2006.01)

(52) U.S. Cl. ..... 347/86; 347/85

(58) Field of Classification Search ..... 385/84–86; 347/84–87

See application file for complete search history.

(56) References Cited

U.S. PATENT DOCUMENTS 5,211,431 A 5/1993 Koizumi et al.
5,291,224 A 3/1994 Asano et al.
5,506,611 A * 4/1996 Ujita et al. ..... 347/86
5,636,929 A 6/1997 Asano et al.
5,734,401 A * 3/1998 Clark et al. ..... 347/86
5,825,387 A 10/1998 Cowger et al.
6,062,667 A 5/2000 Matsui et al.
6,130,695 A 10/2000 Childers et al.
6,281,912 B1 8/2001 Silverbrook
6,286,949 B1 9/2001 Lewis et al.
6,312,084 B1 11/2001 Ujita et al.
6,454,381 B1 9/2002 Olsen et al.
6,467,869 B1 10/2002 Merz et al.
6,502,917 B1 1/2003 Shinada et al.
6,679,584 B2 1/2004 Silverbrook
6,742,857 B2 * 6/2004 Koshikawa et al. ..... 347/19
6,742,872 B2 6/2004 Fukazawa et al.
6,755,514 B2 6/2004 Koga (Continued)

FOREIGN PATENT DOCUMENTS

CN 1134886 A 11/1996

(Continued)

OTHER PUBLICATIONS

European Search Report dated Nov. 13, 2009 in Euro. Pat. App. No. 07 83 1303.

(Continued)

*Primary Examiner* — Ellen Kim

(74) *Attorney, Agent, or Firm* — Stroock & Stroock & Laven LLP

(57) ABSTRACT

A liquid container includes: a container body that is detachably mounted to a container mounting portion of a liquid consuming apparatus and includes a liquid containing portion storing a liquid; a connection port that is provided in the liquid containing portion and delivers the liquid; a liquid delivery portion that is provided in one surface of the container body to supply the liquid to the liquid consuming apparatus; and a plurality of positioning means into which, when the container body is mounted to the liquid consuming apparatus, a plurality of positioning members that are provided on the container mounting portion at positions facing the one surface are fitted, thereby positioning the container body, wherein the liquid delivery portion is provided close to any one of the plurality of positioning means.

31 Claims, 15 Drawing Sheets

U.S. PATENT DOCUMENTS

| | | | | |
|---|---|---|---|---|
| 6,834,945 | B2 | 12/2004 | Ishizawa | |
| 6,843,558 | B2 * | 1/2005 | Seino | 347/85 |
| 7,018,029 | B2 | 3/2006 | Ishizawa | |
| 7,063,409 | B2 | 6/2006 | Koga | |
| 7,152,965 | B2 | 12/2006 | Ishizawa et al. | |
| 7,377,627 | B2 | 5/2008 | Muranaka et al. | |
| 7,404,628 | B2 | 7/2008 | Naka et al. | |
| 7,448,734 | B2 | 11/2008 | Silverbrook | |
| 7,566,106 | B2 | 7/2009 | Silverbrook | |
| 7,976,121 | B2 * | 7/2011 | Harada | 347/31 |
| 2002/0175977 | A1 | 11/2002 | Hanson | |
| 2004/0196339 | A1 * | 10/2004 | Kobayashi et al. | 347/85 |
| 2005/0036015 | A1 | 2/2005 | Seino et al. | |
| 2005/0052511 | A1 | 3/2005 | Seino et al. | |
| 2005/0057622 | A1 * | 3/2005 | Kimura et al. | 347/86 |
| 2005/0174370 | A1 * | 8/2005 | Sarmast et al. | 347/7 |
| 2005/0179748 | A1 * | 8/2005 | Malik et al. | 347/85 |
| 2005/0270343 | A1 * | 12/2005 | Malik et al. | 347/85 |
| 2006/0238581 | A1 | 10/2006 | Yoshimura et al. | |
| 2009/0237448 | A1 * | 9/2009 | Kimura et al. | 347/36 |
| 2009/0262154 | A1 | 10/2009 | Silverbrook | |

FOREIGN PATENT DOCUMENTS

| | | | |
|---|---|---|---|
| DE | 90 18 060.7 | | 8/1990 |
| EP | 0 891 867 | | 1/1999 |
| EP | 0 940 260 | | 9/1999 |
| EP | 1 164 025 | | 12/2001 |
| EP | 1247651 | | 10/2002 |
| EP | 1375159 | | 6/2003 |
| EP | 1 346 834 | | 9/2003 |
| EP | 1354708 | | 10/2003 |
| EP | 1 380 428 | | 1/2004 |
| JP | 2002-088248 | | 3/1990 |
| JP | A-03-193480 | | 8/1991 |
| JP | A-03-197782 | | 8/1991 |
| JP | U-04-119078 | | 10/1992 |
| JP | A-08-169121 | | 7/1996 |
| JP | 11-348308 | A | 12/1999 |
| JP | A-2002-001980 | | 6/2000 |
| JP | 2001-58417 | A | 3/2001 |
| JP | 2001-150691 | | 6/2001 |
| JP | A-2001-341323 | | 12/2001 |
| JP | 2002-019135 | A | 1/2002 |
| JP | 2003-011390 | A | 1/2003 |
| JP | A-2003-175589 | | 6/2003 |
| JP | 2004-142128 | | 5/2004 |
| JP | 2004-167685 | A | 6/2004 |
| JP | 2004-195962 | A | 7/2004 |
| JP | 2005-088575 | A | 4/2005 |
| JP | 2005-96446 | A | 4/2005 |
| TW | 200508040 | A | 3/1993 |

OTHER PUBLICATIONS

Office Action issued in U.S. Appl. No. 11/855,263 on Jun. 4, 2010.
Taiwanese Office Action, dated May 26, 2010, in Taiwanese Patent Appln. No. 096141914.
Chinese Office Action, dated Jun. 12, 2010, in Chinese Patent Appln. No. 200780041179.3.
Chinese Office Action, dated Aug. 4, 2010, in Chinese Patent Appln. No. 200780040935.0.
International Search Report in PCT/JP2007/067982 dated Dec. 10, 2007.
European Search Report, dated Feb. 18, 2011 in EP No. 10187444.4.
Korean Office Action dated Mar. 9, 2011 in KR 2009-7009039.
English translation of Korean Office Action dated Mar. 9, 2011 in KR 2009-7009039.
Extended Search Report, dated Nov. 6, 2009, in European Patent Appln. No. 07807386.3.

* cited by examiner

LIQUID CONTAINER

BACKGROUND

1. Technical Field

The present invention relates to a liquid container that is detachably mounted to a container mounting portion of a liquid consuming apparatus and supplies a liquid stored in a liquid containing portion to the liquid consuming apparatus.

2. Related Art

As a liquid container for containing a liquid used for a liquid consuming apparatus, for example, an ink cartridge used for an ink jet printer has been known. In the ink cartridge for the ink jet printer, an ink containing chamber having ink to be supplied to a printing head (a liquid containing portion) is provided in a container body, and the ink cartridge is detachably mounted to a cartridge mounting portion (a container mounting portion) provided at a predetermined position when it is used. The ink contained in the ink containing chamber is supplied to a printing head that is driven according to printing data transmitted from a host computer, and is then discharged at target positions onto a printing medium, such as a sheet, from nozzles provided in the printing head.

In general, the ink jet printer includes a carriage that has a printing head for discharging ink droplets and reciprocates in a direction orthogonal to the direction in which a printing medium is transported. In addition, ink can be supplied from the ink cartridge to the printing head by the following methods. First, an ink cartridge is detachably mounted to a cartridge mounting portion provided in the carriage, and ink is supplied to the printing head from the ink cartridge that is reciprocated together with the printing head (a so-called on-carriage type). Second, an ink cartridge is detachably mounted to a cartridge mounting portion that is separately provided from a carriage of the ink jet printer, and ink is supplied from the ink cartridge to the printing head through an ink passage formed of, for example, a flexible tube (a so-called off-carriage type).

Various types of ink cartridges including an ink cartridge disclosed in Patent Document 1 have been proposed as the ink cartridge mounted to an off-carriage type of ink jet printer.

An ink cartridge 201 shown in FIGS. 15 and 16 is disclosed in Patent Document 1. In the ink cartridge 201, an ink pack 209 whose volume can be reduced by pressure caused by pressurized air, which is supplied from a pressure chamber 207 of a container body 205, is accommodated in the container body 205 that is mounted to a cartridge mounting portion 203 of the ink jet printer, and the ink pack 209 contains ink used for the ink jet printer.

As shown in FIG. 16, one surface of the container body 205 (a leading end surface of the container body in a direction in which the container body is mounted) is provided with two positioning engaging portions (positioning means) 213 into which two positioning members 211 provided on the cartridge mounting portion 203 are fitted, thereby positioning the container body 205; an ink delivery port (a liquid delivery portion) 217 that connects an ink supply passage (a liquid supply portion) 215 of the cartridge mounting portion 203 to the ink pack 209; and a pressurized air inlet 221 that connects a pressurized air supply passage 219 of the cartridge mounting portion 203 to a pressure chamber 207. In the ink cartridge 201, the ink delivery port 217 is provided substantially at the center of one surface of the container body 205.

As shown in FIG. 17, in the ink pack 209, the ink delivery port 217 for delivering the ink contained in the ink pack 209 to the outside is provided in a flexible pouch 216. For example, the flexible pouch 216 is formed by overlapping two laminated films and bonding the edges of the laminated films by fusing.

Patent Document 1: JP-A-2002-19135

However, in recent years, with an increase in the size of a liquid container, errors in the formation or assembly of the container body 205 have increased, and the tolerance between the positioning engaging portion 213 and the ink delivery port 217 has increased.

When the ink cartridge 201 is mounted to the cartridge mounting portion 203, the positional accuracy between the ink supply passage 215 and the ink delivery port 217 is lowered. As a result, the ink supply passage 215 is not smoothly connected to the ink delivery port 217, and the mountability of the ink cartridge is likely to be lowered.

In addition, in recent years, the number of liquid containers mounted to the ink jet printer has increased in order to improve a printing quality. Therefore, it is assumed that the liquid container is vertically arranged in order to accommodate the liquid container at a high density.

In the structure in which the ink cartridge 201 is vertically arranged, when the amount of ink filled into the ink pack 209 increases due to an increase in the size of the liquid container, the internal pressure of the ink pack increases even when no pressure is applied. As a result, the leakage of ink from the ink delivery port 217 is likely to increase.

SUMMARY

An object of the present invention is to provide a liquid container capable of preventing the deterioration of connection between a liquid delivery portion and a liquid supply portion due to an increase in the size of the liquid container and preventing the leakage of a liquid from the liquid delivery portion.

MEANS TO ACCOMPLISH THE SUBJECTS

The object of the present invention is achieved by a liquid container including: a container body that is detachably mounted to a container mounting portion of a liquid consuming apparatus and includes a liquid containing portion storing a liquid; a connection port that is provided in the liquid containing portion and delivers the liquid; a liquid delivery portion that is provided in one surface of the container body to supply the liquid to the liquid consuming apparatus; and a plurality of positioning means into which, when the container body is mounted to the liquid consuming apparatus, a plurality of positioning members that are provided on the container mounting portion at positions facing the one surface are fitted, thereby positioning the container body. In the liquid container, the liquid delivery portion is provided close to any one of the plurality of positioning means.

According to the liquid container having the above-mentioned structure, since the liquid delivery portion is provided close to the positioning means that is formed in one surface, it is possible to reduce the influence of an increase in the tolerance between the positioning member of the container mounting portion and the positioning means of the container body, which is more likely to occur due to an increase in the size of the ink cartridge. Therefore, it is possible to improve the positional accuracy between the liquid supply portion of the container mounting portion and the liquid delivery portion of the container body, and smoothly connect the liquid supply portion and the liquid delivery portion. As a result, it is possible to prevent the deterioration of the mountability of a liquid container.

In the liquid container having the above-mentioned structure, preferably, the liquid delivery portion is provided at a position that deviates from a center line of an opening of the connection port.

According to the liquid container having the above-mentioned structure, a passage extending in the width direction of the container body is formed between the connection port and the liquid delivery portion. Therefore, it is possible to provide an additional function unit in a portion of the passage while minimizing the length of the container body in the longitudinal direction (lengthwise direction) thereof. As a result, it is possible to form a small liquid container provided with an additional function unit, such as a residual amount detecting unit or an air bubble trap chamber.

Preferably, the liquid container having the above-mentioned structure further includes: an offset passage member that has a passage through which the connection port communicates with the liquid delivery portion; and an engaging means that is provided in a connecting portion between the container body and the offset passage member and enables the offset passage member to be detachably engaged with the container body by rotation.

According to the liquid container having the above-mentioned structure, the use of the offset passage member makes it easy to provide the liquid delivery portion at a position that deviates from the center line of an opening of the connection port. As a result, the flexibility of the position where the liquid delivery portion is formed is improved.

In addition, the offset passage member is attached to the container body by a simple operation of engaging the engaging portions that are provided in a connecting portion between the offset passage member and the container body using an engaging means and rotating the offset passage member.

The object of the invention is also achieved by a liquid container including: a container body that is detachably mounted to a container mounting portion of a liquid consuming apparatus and supplies a liquid stored in a liquid containing portion to the liquid consuming apparatus; a connection port that is provided in the liquid containing portion and delivers the liquid; and a liquid delivery portion which is provided in a leading end surface of the container body in a direction in which the container body is mounted and through which the connection port communicates with a liquid supply portion that is provided in the container mounting portion. In the liquid container, the liquid delivery portion is provided above the center of the leading end surface of the container body in the direction in which the container body is mounted in the height direction when the container body is mounted to the liquid consuming apparatus.

According to the liquid container having the above-mentioned structure, in general, the liquid delivery portion of the container body is positioned above the connection port of the liquid containing portion that is disposed at a height substantially equal to the center of the leading end surface of the container body in the direction in which the container body is mounted, when the container body is mounted to the liquid consuming apparatus. Therefore, it is possible to reduce the static pressure of the liquid delivery portion by a value corresponding to the water head difference thereof, and thus reduce the leakage of a liquid from the liquid delivery portion.

In the liquid container having the above-mentioned structure, preferably, the liquid delivery portion is provided at a position that deviates from a center line of an opening of the connection port.

According to the liquid container having the above-mentioned structure, a passage extending in the width direction of the container body is formed between the connection port and the liquid delivery portion. Therefore, it is possible to provide an additional function unit in a portion of the passage while minimizing the length of the container body in the longitudinal direction (lengthwise direction) thereof. As a result, it is possible to form a small liquid container provided with an additional function unit, such as a residual amount detecting unit or an air bubble trap chamber.

Preferably, the liquid container having the above-mentioned structure further includes: an offset passage member that has a passage through which the connection port communicates with the liquid delivery portion; and an engaging means that is provided in a connecting portion between the container body and the offset passage member and enables the offset passage member to be detachably engaged with the container body by rotation.

According to the liquid container having the above-mentioned structure, the use of the offset passage member makes it easy to provide the liquid delivery portion at a position that deviates from the center line of an opening of the connection port. As a result, the flexibility of the position where the liquid delivery portion is formed is improved.

In addition, the offset passage member is attached to the container body by a simple operation of engaging the engaging portions that are provided in a connecting portion between the offset passage member and the container body using an engaging means and rotating the offset passage member.

The object of the invention is also achieved by a liquid container including: a container body that is detachably mounted to a container mounting portion of a liquid consuming apparatus and supplies a liquid stored in a liquid containing portion to the liquid consuming apparatus; a connection port that is provided in the liquid containing portion and delivers the liquid; a liquid delivery portion which is provided in a leading end surface of the container body in a direction in which the container body is mounted and through which the connection port communicates with a liquid supply portion that is provided in the container mounting portion; and two concave portions into which two convex portions that are provided on the container mounting portion at positions facing the leading end surface of the container body in the direction in which the container body is mounted are fitted. In the liquid container, the liquid delivery portion is provided close to one of the two concave portions provided at both sides of the leading end surface of the container body in the direction in which the container body is mounted in the width direction thereof.

Further, the object of the invention is also achieved by a liquid container that is detachably mounted to a container mounting portion of a liquid consuming apparatus. The liquid container includes: a liquid containing portion that stores a liquid; a connection port that is provided in the liquid containing portion and delivers the liquid; a liquid delivery portion which is provided in a front wall of the liquid container and supplies the liquid to the liquid consuming apparatus; and first and second positioning holes which are provided at both sides of the front wall and into which first and second positioning members that are provided on the container mounting portion at positions facing the front wall are fitted when the liquid container is mounted to the liquid consuming apparatus, thereby positioning a container body. In the liquid container, the liquid delivery portion is provided closer to the first positioning hole than to the second positioning hole.

In the liquid container having the above-mentioned structure, preferably, the first positioning hole is positioned at above the second positioning hole when the liquid container is mounted to the liquid consuming apparatus.

Preferably, the liquid container having the above-mentioned structure further includes a side wall that is orthogonal to the front wall and is positioned at an upper side when the liquid container is mounted to the liquid consuming apparatus. In the liquid container, preferably the side wall is provided with a circuit board that can be connected to connection terminals of the liquid consuming apparatus.

Preferably, the liquid container having the above-mentioned structure further includes a side wall that is orthogonal to the front wall and is positioned at a lower side when the liquid container is mounted to the liquid consuming apparatus. In the liquid container, preferably, the side wall is provided with an engaging portion that can be engaged with an engaging means provided in the liquid consuming apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
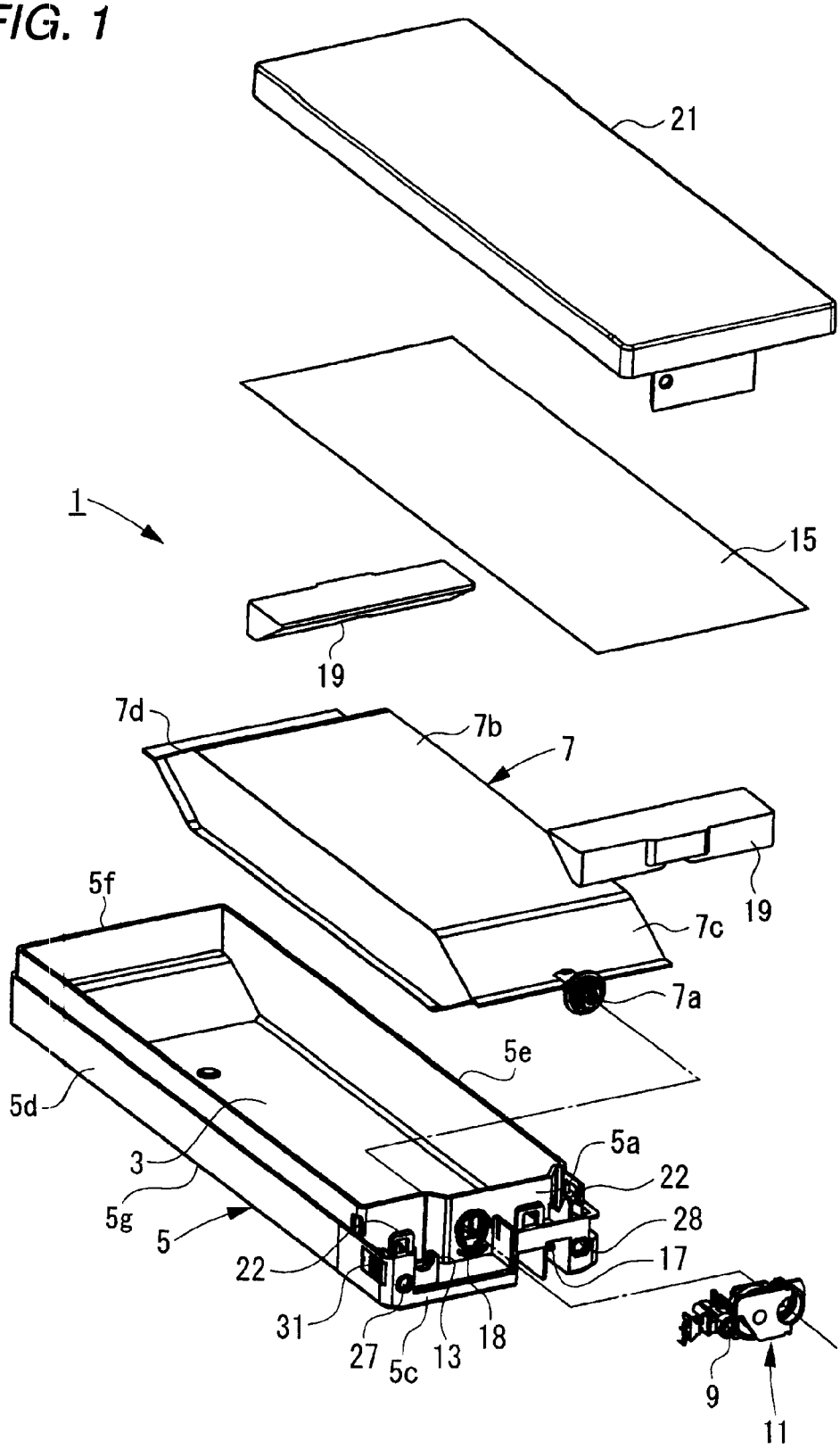
FIG. 1 is an exploded perspective view illustrating a liquid container according to a first embodiment of the invention.
Figure 2:
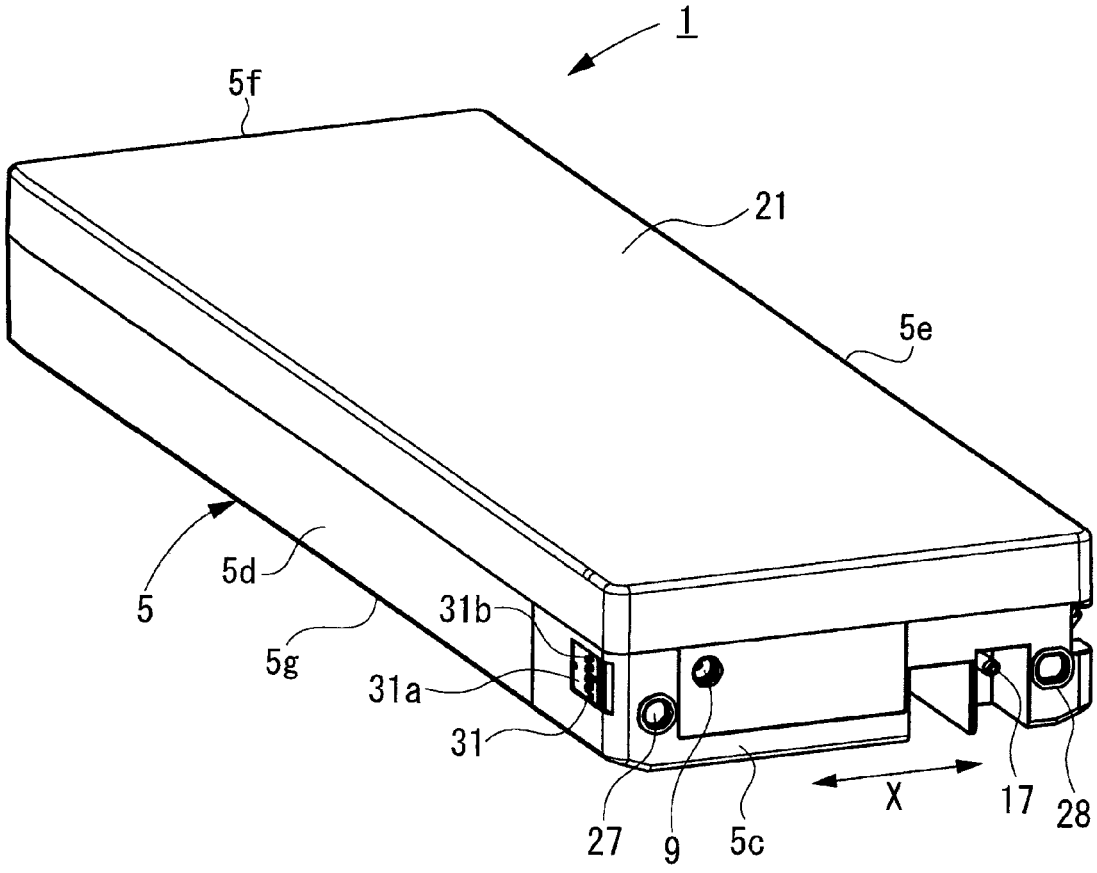
FIG. 2 is a perspective view illustrating the liquid container shown in FIG. 1 that is assembled.
Figure 3B:
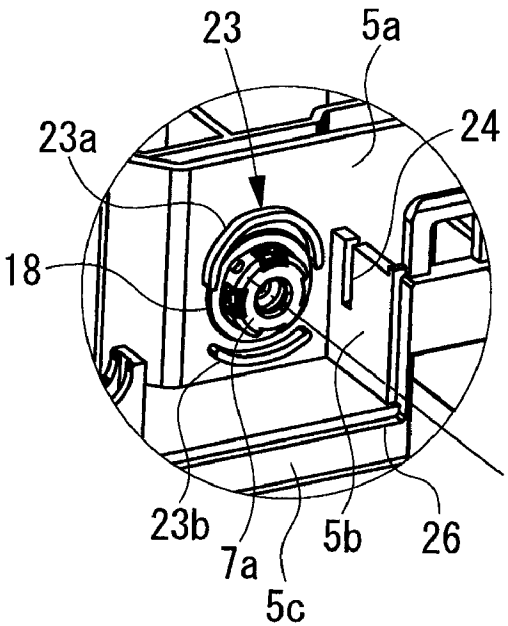
FIG. 3*b* is an enlarged view illustrating a portion A of the liquid container shown in FIG. 3*a*.
Figure 3A:
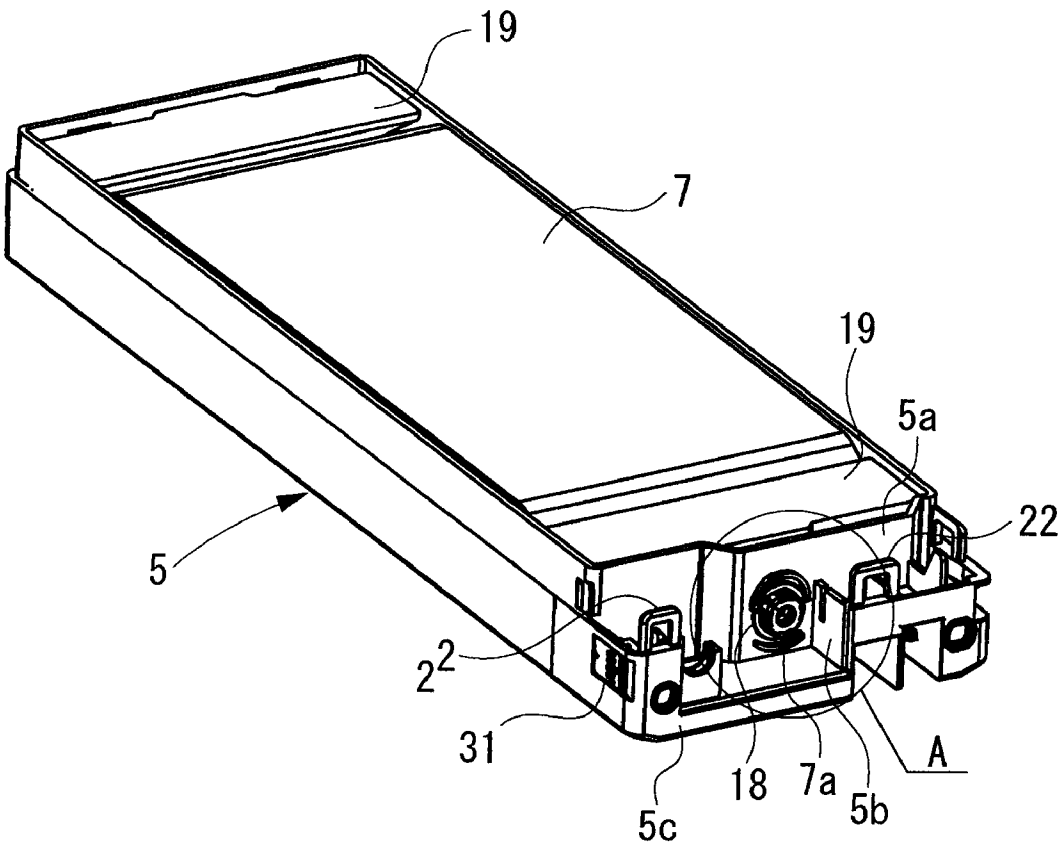
FIG. 3*a* is a perspective view illustrating the liquid container, which is shown in FIG. 1, having an ink pack, which is a liquid containing portion, and a spacer for filling up a peripheral gap of the ink pack provided in a pouch accommodating portion of a container body.
Figure 4:
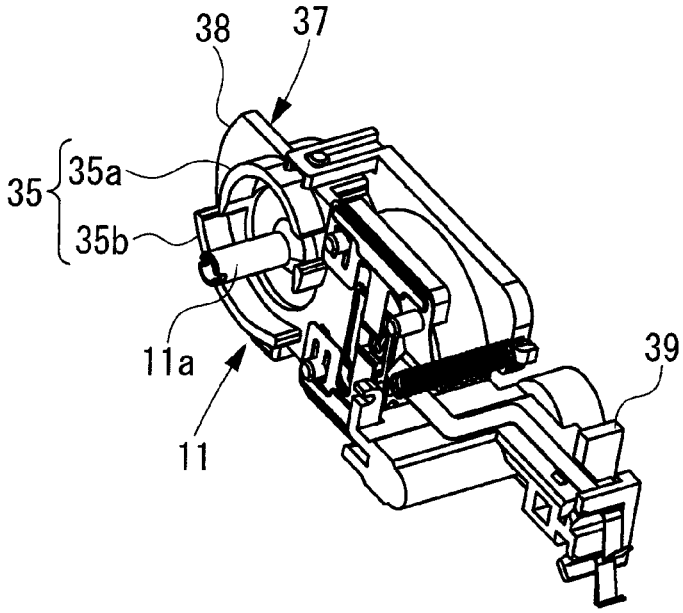
FIG. 4 is a perspective view of a residual amount detecting unit shown in FIG. 1, as viewed from the rear side.

Hereinafter, a liquid container according to an embodiment of the invention will be described in detail with reference to the accompanying drawings. FIG. 1 is an exploded perspective view illustrating a liquid container according to a first embodiment of the invention, and FIG. 2 is a perspective view illustrating the liquid container shown in FIG. 1 that is assembled. FIG. 3*a* is a perspective view illustrating the liquid container, which is shown in FIG. 1, having an ink pack, which is a liquid containing portion, and a spacer for filling up a peripheral gap of the ink pack provided in a pouch accommodating portion of a container body, and FIG. 3*b* is an enlarged view illustrating a portion A of the liquid container shown in FIG. 3*a*. FIG. 4 is a perspective view of a residual amount detecting unit shown in FIG. 1, as viewed from the rear side.

Figure 10A:
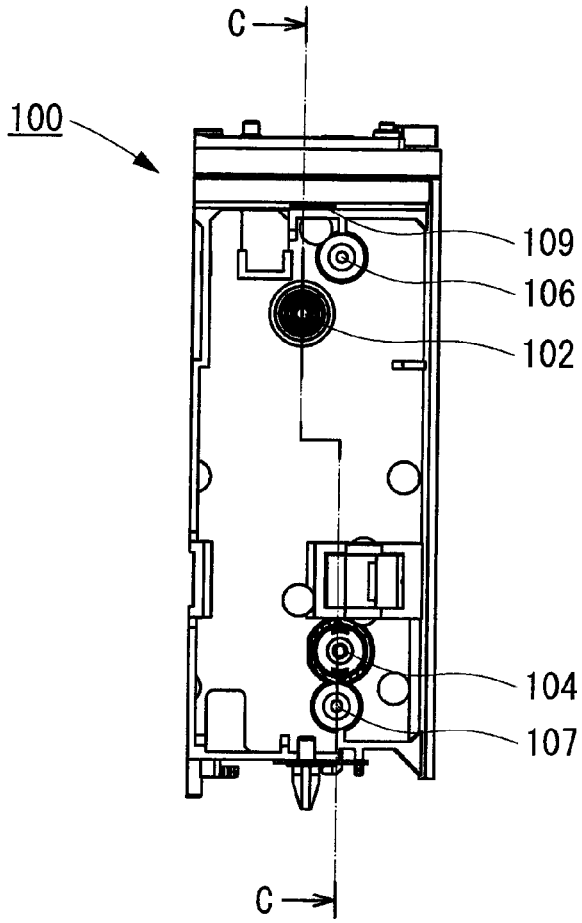
FIG. 10A is a front view illustrating a container mounting portion of a liquid consuming apparatus.
Figure 10B:
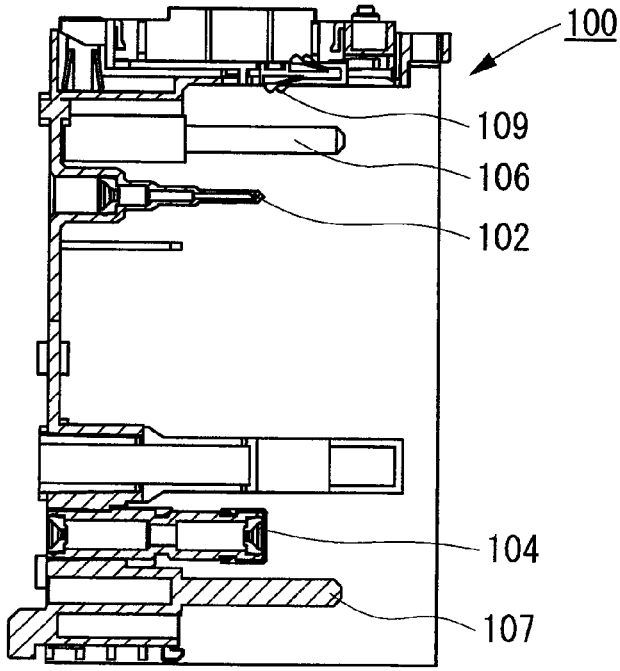
FIG. 10B is a cross-sectional view taken along the line C-C of FIG. 10A.

An ink cartridge (liquid container) 1 shown in FIGS. 1 and 2 is detachably mounted to a cartridge mounting portion (container mounting portion) 100 of a commercial ink jet printing apparatus (liquid consuming apparatus) and supplies ink to a printing head (ink ejecting head) provided in the printing apparatus (see FIG. 10).

The ink cartridge 1 according to this embodiment includes: a container body 5 that is detachably mounted to the cartridge mounting portion 100 of an ink jet printing apparatus and supplies ink (liquid) stored in an ink pack 7, serving as a liquid containing portion, to a printing head provided in a printing apparatus; a connection port 7*a* that delivers ink contained in the ink pack 7; a liquid delivery portion 9 which is provided in a front wall 5*c*, which is a lead end surface of the liquid container 5 in the direction in which the container body 5 is mounted, and through which a liquid supply portion 102 provided in the cartridge mounting portion 100 communicates with the connection port 7*a*; and two positioning holes (positioning means) 27 and 28 into which two positioning pins (positioning members) 106 and 107 provided on the container mounting portion 100 at positions facing the front wall 5*c* are fitted, thereby regulating the movement of the container body along the front wall 5*c*.

The ink pack 7 of the ink cartridge 1 is accommodated in a pouch accommodating portion 3 that is pressed by a pressure unit, and when the pouch accommodating portion 3 is pressed, ink contained in the ink pack 7 is discharged through the connection port 7*a*.

The ink delivery portion 9 for supplying ink to an external printing head is provided in a residual amount detecting unit 11, serving as an additional function unit that is detachably mounted to the container body 5. The residual amount detecting unit 11 is an offset passage member having a passage that communicates between the connection port 7*a* of the ink pack 7 and the liquid delivery portion 9, and has a detecting unit engaging portion (engaging means) in a connection portion between the container body 5 and the residual amount detecting unit 11. The residual mount detecting unit 11 rotates with respect to the container body 5 to be attached to or detached from the container body 5 by the detecting unit engaging portion 23.

The container body 5 is a case formed by resin molding, and includes the substantially box-shaped pouch accommodating portion 3 with an open upper surface, and a detecting unit accommodating portion 13 that is disposed in front of the pouch accommodating portion 3 and accommodates the residual amount detecting unit 11. The pouch accommodating portion 3 is partitioned from the detecting unit accommodating portion 13.

That is, the container body 5 of the ink cartridge 1 includes the front wall 5*c*, a rear wall 5*f*, a first side wall 5*d* that is disposed at an upper part when the ink cartridge 1 is mounted to the cartridge mounting portion 100 of the ink jet printing apparatus (hereinafter, referred to as a mounted state of the ink cartridge), a second side wall 5*e* that is disposed at a lower part in the mounted state of the ink cartridge 1, a third side wall 5*g* that serves as a vertical surface in the mounted state of the ink cartridge 1, and a partition wall 5*a* that partitions the pouch accommodating portion 3 from the detecting unit accommodating portion 13.

An open upper surface of the pouch accommodating portion 3 is sealed by a sealing film 15 after the ink pack 7 is put inside the pouch accommodating portion 3. In this way, the pouch accommodating portion 3 serves as a sealed chamber, and is pressed by a pressure unit.

The partition wall 5*a* partitioning the pouch accommodating portion 3 from the detecting unit accommodating portion 13 is provided with a pressure hole 17, which is a passage for supplying pressurized air to the sealed pouch accommodating portion 3. When the ink cartridge 1 is mounted to the cartridge mounting portion 100 of the ink jet printing apparatus, a pressurized air supply unit 104 of the cartridge mounting portion shown in FIG. 10 is connected to the pressure hole 17, and the ink pack 7 is pressed by the pressurized air supplied into the pouch accommodating portion 3.

The ink pack 7 is formed by bonding a cylindrical connection port 7*a* into which a connection needle 11*a* (see FIG. 4) of the residual amount detecting unit 11 is inserted to one end of a flexible pouch 7*b* that is formed of an aluminum-laminated multilayer film having a resin film and an aluminum layer formed thereon. In addition, the aluminum-laminated multilayer film can ensure high gas barrier properties.

The detailed structure of the liquid containing portion is not limited to the ink pack 7. For example, a structure that fills up a container with ink and covers the ink with a film may be used well as the ink pack using the flexible pouch.

The connection port 7*a* of the ink pack 7 airtightly passes through a connection port insertion opening 18 formed in the partition wall 5*a* such that a leading end thereof protrudes from the detecting unit accommodating portion 13, as shown in FIG. 3. Before the residual amount detecting unit 11 is connected to the ink pack 7, the ink pack 7 is filled with deaerated ink.

When the ink pack 7 is mounted to the pouch accommodating portion 3, spacers 19 formed of resin are mounted to front and rear inclined portions 7*c* and 7*d* of the flexible pouch 7*b*. When the upper surface of the pouch accommodating portion 3 is covered with the sealing film 15 to be sealed, the spacers 19 formed of resin prevent the ink pack 7 from rattling in the sealed pouch accommodating portion 3, and prevent pressure caused by the movement of ink when the ink cartridge 1 drops from being concentrated on a fused portion of the ink pack 7.

A cover 21 formed of resin is mounted onto the sealing film 15 covering the open surfaces of the pouching accommodating portion 3 and the detecting unit accommodating portion 13. When the cover 21 formed of resin covers the upper surface of the container body 5, an engaging means (not shown) is engaged with an engaging portion provided on the second side wall 5*e* of the container body 5 to fix the case 21 to the container body 5.

As shown in FIG. 3*b*, the detecting unit engaging portion 23, which is a connecting portion with which the residual amount detecting unit 11 is rotatably engaged, is provided around the opening 18 formed in the partition wall 5*a*. In this embodiment, the detecting unit engaging portion 23 includes two curved convex walls 23*a* and 23*b*, and the convex walls 23*a* and 23*b* form a ring structure for regulating the rotation center of the residual amount detecting unit 11.

As shown in FIG. 3*b*, a locking groove 24 for preventing the residual detecting unit 11 engaged with the detecting unit engaging portion 23 from being detached therefrom is provided in a partition wall 5*b* that is provided on the detecting unit accommodating portion 13 so as to be orthogonal to the partition wall 5*a* at a position close to the detecting unit engaging portion 23.

An opening 26, which is a cutout, is formed in the front wall (the leading end of the container body in the direction in which the container body is mounted) 5*c* of the container body 5, which is a partition wall covering the front surface of the detecting unit accommodating portion 13, at a position facing the detecting unit engaging portion 23, in order to attach the residual amount detecting unit 11.

As shown in FIG. 2, positioning holes 27 and 28 into which positioning pins 106 and 107 provided on the cartridge mounting portion 100 when the ink cartridge 1 is mounted to the cartridge mounting portion 100 are provided at both sides of the front wall 5*c* (see FIG. 10). The positioning hole 27 is formed in a circular shape, and the positioning hole 28 is formed in a shape that is elongated in the width direction (in the direction of an arrow X in FIG. 2) of the container body 5. The elongated positioning hole 28 makes it possible to improve positioning accuracy and easily allow a tolerance.

Figure 7:
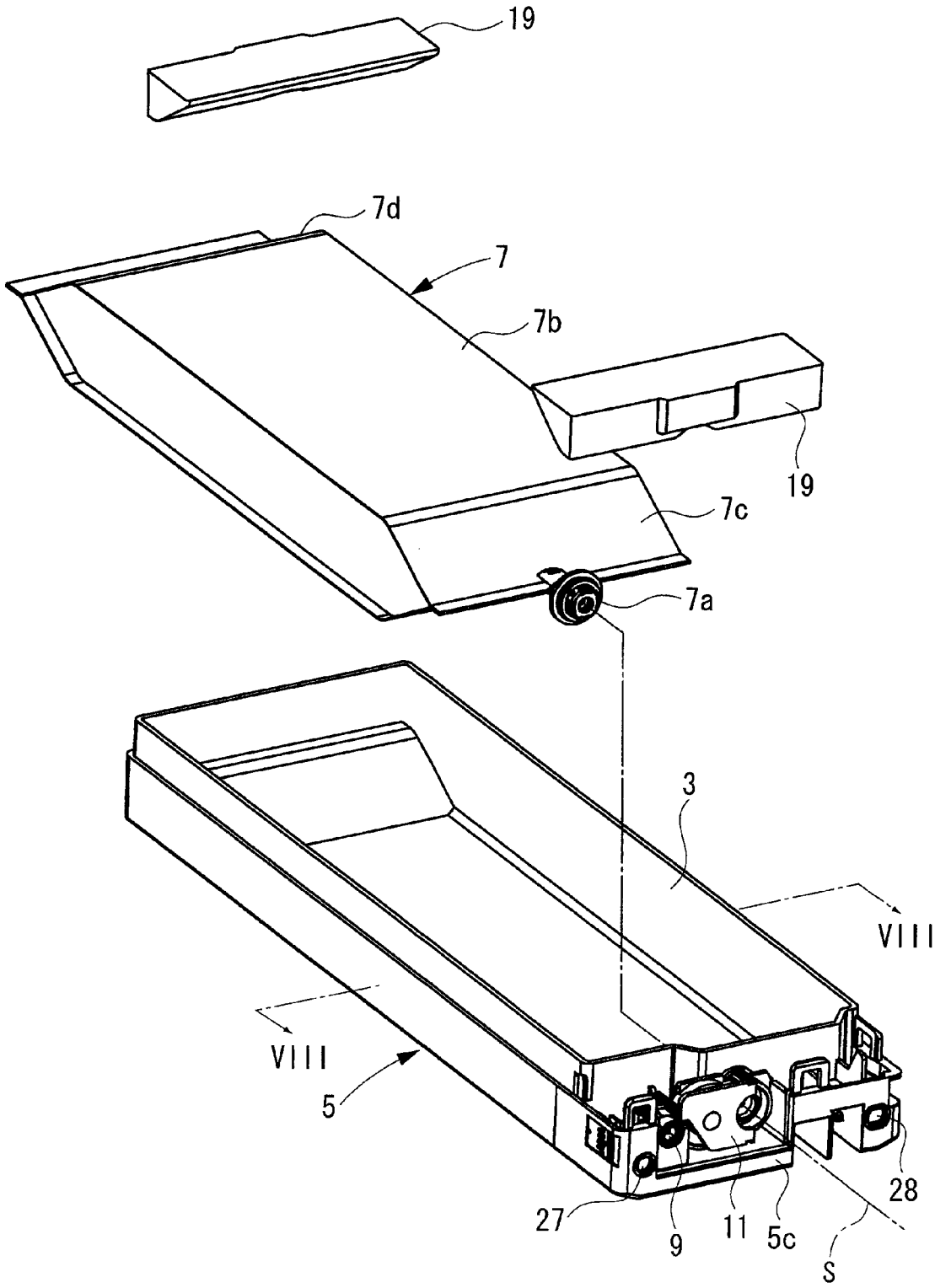
FIG. 7 is a perspective view illustrating a process of assembling the liquid container.

As shown in FIG. 7, the liquid delivery portion 9 formed in the front wall 5*c* is provided between the positioning hole 27 (first positioning hole) and the positioning hole 28 (second positioning hole) that are formed at both sides of the front wall 5*c* in the width direction thereof so as to be closer to the positioning hole 27 than to the positioning hole 28. In addition, the liquid delivery portion 9 is arranged above a virtual line linking the two positioning holes 27 and 28 in the vertical direction of FIG. 7. Therefore, the position of the connection port 7*a* of the ink pack 7 deviates from the position of the liquid delivery portion 9 in the horizontal direction of FIG. 7. That is, the liquid delivery portion 9 is disposed at an offset position that deviates from a center line S of the connection port 7*a*.

Actually, when the ink cartridge 1 is inserted into the ink jet printing apparatus, the ink cartridge shown in FIG. 7 is rotated 90 degrees in the clockwise direction. Therefore, the liquid delivery portion 9 is provided above the center of the front wall 5*c* (on the center line S of an opening of the connection port 7*a*) in the height direction when the container is used.

A circuit board 31 that is electrically connected to connection terminals 109 of the cartridge mounting portion 100 when the ink cartridge 1 is mounted to the cartridge mounting portion 100 is provided on the first side wall 5*d* of the liquid container 5 close to the circular positioning hole 27 at a position leaning toward the front surface (see FIG. 10).

The circuit board 31 electrically connects a memory device provided on the rear surface thereof or a piezoelectric device provided on the residual amount detecting unit 11 to a control circuit of the ink jet printing apparatus such that the control circuit of the ink jet printing apparatus can control the memory device or the piezoelectric device.

As shown in FIGS. 1 and 4, the residual amount detecting unit 11 according to the first embodiment, serving as the offset passage member, includes: a container engaging portion 35, which is a connecting portion that is rotatably engaged with the detecting unit engaging portion 23 (see FIG.

3) of the container body 5; a fixing means 37 that fixes the residual amount detecting unit 11 to the container body 5 when the residual amount detecting unit 11 rotates with the container engaging portion 35 being engaged with the detecting unit engaging portion 23; an internal passage (not shown) that guides the ink contained in the flexible pouch 7*b* to the liquid delivery portion 9 through the connection needle 11*a* connected to the connection port 7*a*; and a sensor (not shown) that detects the residual amount of ink from the state of ink in the internal passage (a variation in pressure).

In this embodiment, the container engaging unit 35 includes two curved convex walls 35*a* and 35*b* that are formed so as to be detachable from the convex walls 23*a* and 23*b* of the detecting unit engaging portion 23 and to rotate to be engaged with the convex walls 23*a* and 23*b*, respectively. The convex walls 35*a* and 35*b* form a ring structure for regulating the rotation center of the residual amount detecting unit 11.

In the above-mentioned structure, the detecting unit engaging portion 23 formed on the partition wall 5*a* and the container engaging portion 35 provided on the residual amount detecting unit 11 form an engaging means for rotatably connecting the container body 5 and the residual amount detecting unit 11.

The fixing means 37 includes a locking piece 38 that protrudes from the outer circumferential surface of the container engaging portion 35 and an engaging portion 39 that is provided on a leading end thereof that rotates.

Figure 5:
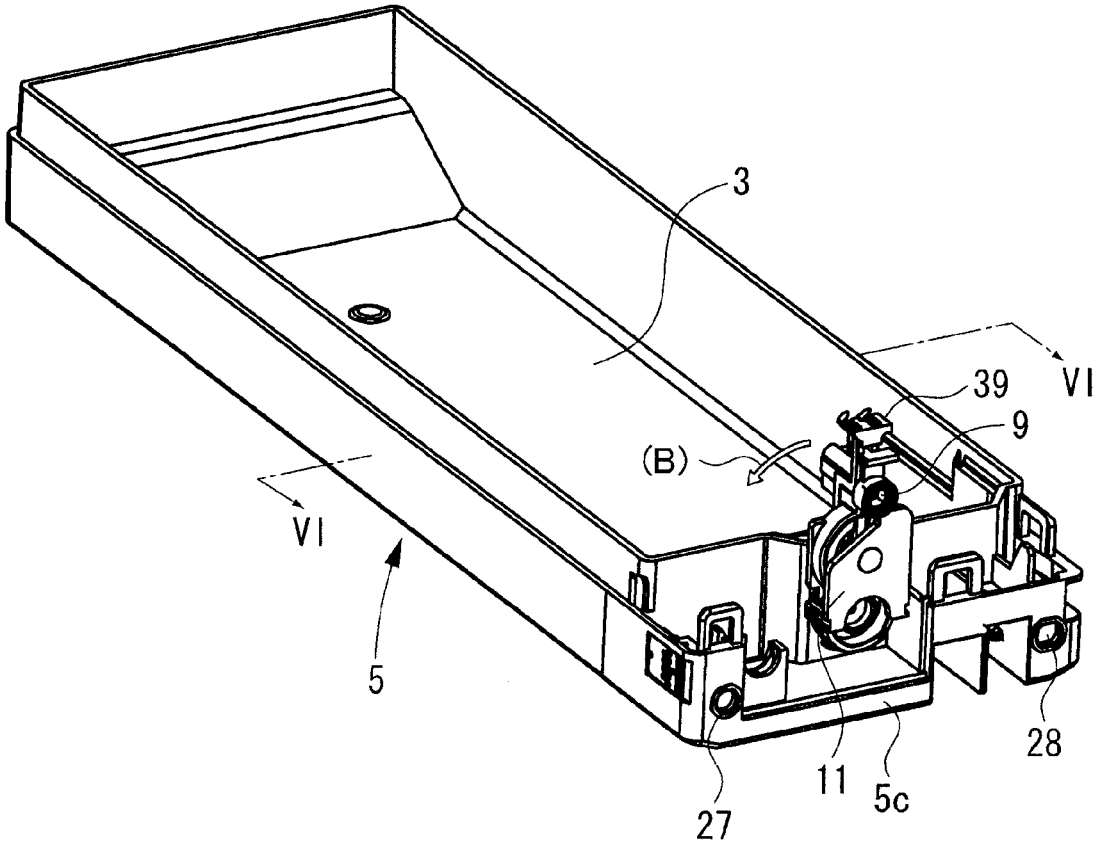
FIG. 5 is a perspective view illustrating the residual amount detecting unit engaged with a detecting unit engaging portion.
Figure 8:
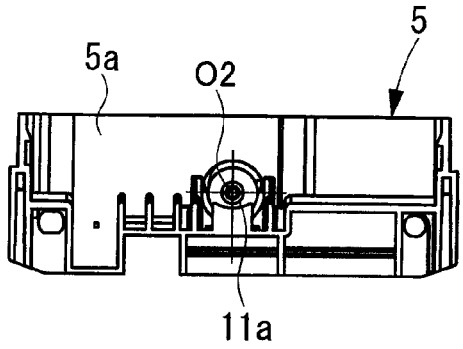
FIG. 8 is a cross-sectional view taken along the line VIII-VIII of FIG. 7.
Figure 9:
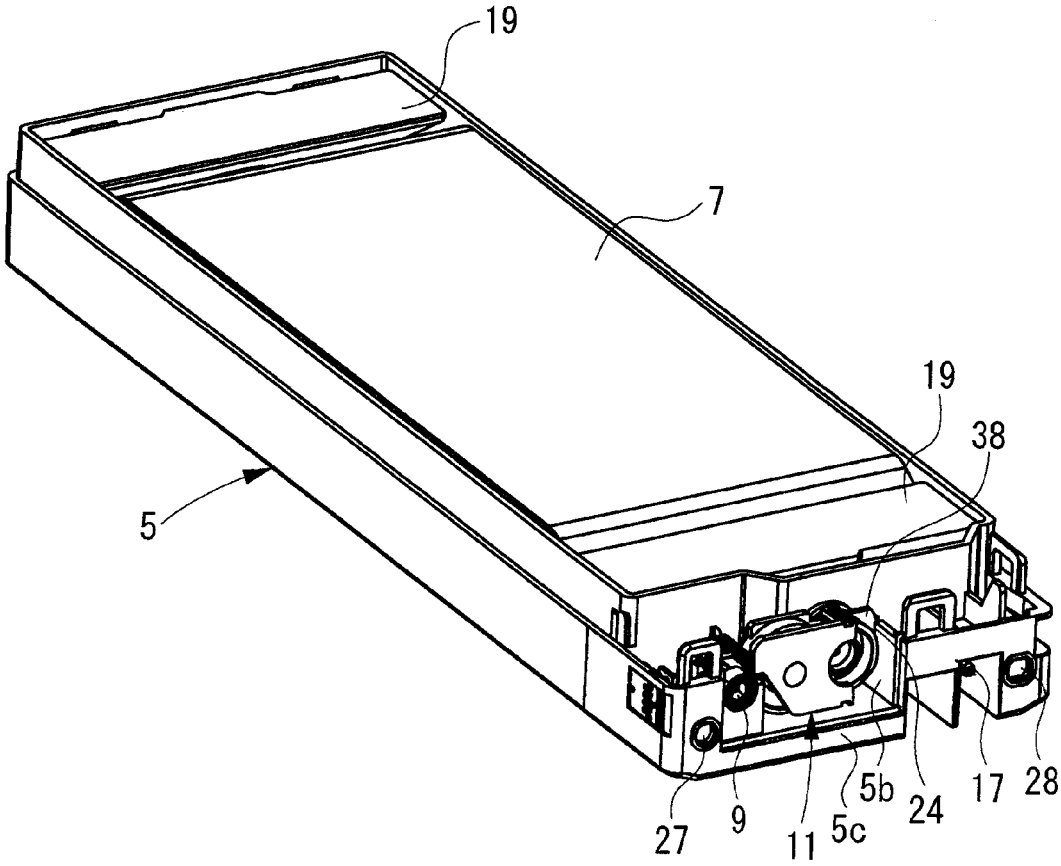
FIG. 9 is a perspective view illustrating the liquid container shown in FIG. 7 that is completely assembled.

As shown in FIG. 5, the locking piece 38 is fitted to the locking groove 24 (see FIG. 3) of the container body 5 when the residual amount detecting unit 11 is rotated in the direction of an arrow (B) with the container engaging portion 35 being engaged with the detecting unit engaging portion 23, thereby retaining the connection between the engaging portion and the cartridge mounting portion, as shown in FIGS. 7 and 8. Meanwhile, as shown in FIG. 5, the engaging portion 39 is engaged with an engaging portion of the container body 5 when the residual amount detecting unit 11 is rotated in the direction of the arrow (B) with the container engaging portion 35 being engaged with the detecting unit engaging portion 23, thereby regulating the rotation of the residual amount detecting unit 11.

Figure 6:
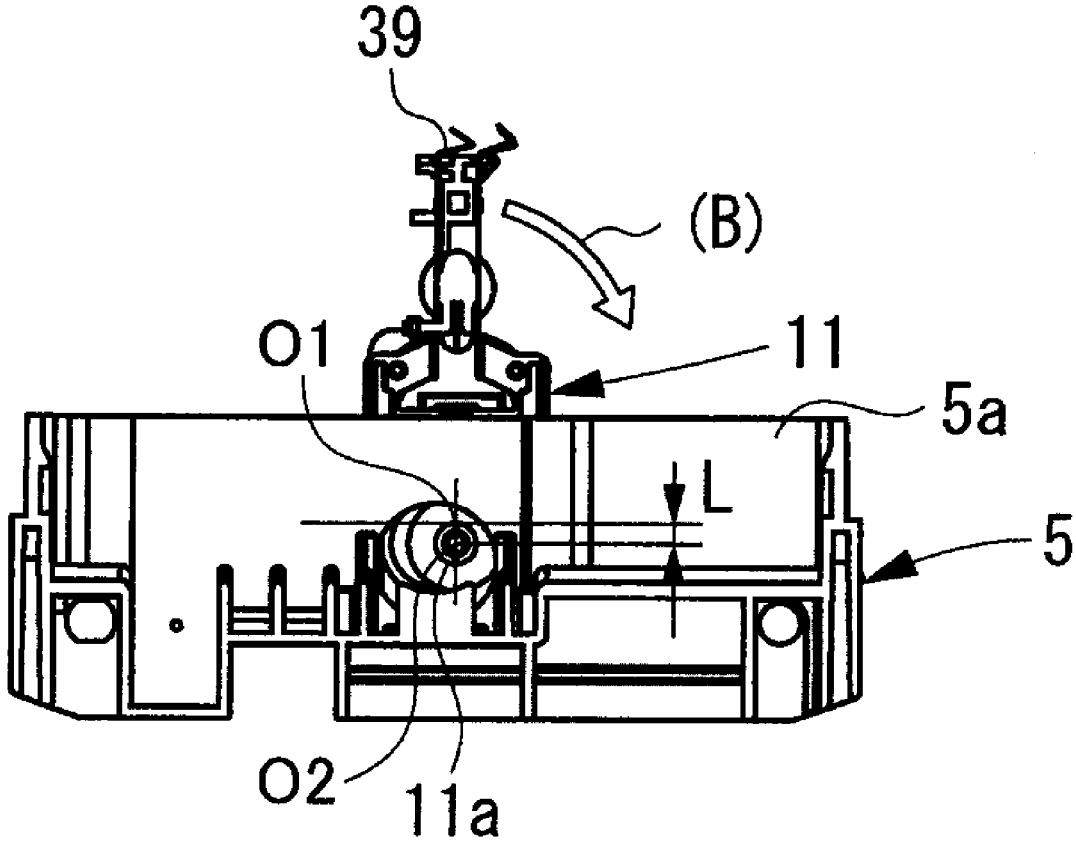
FIG. 6 is a cross-sectional view taken along the line VI-VI of FIG. 5.

In this embodiment, as shown in FIG. 6, a rotation center O1 of the container engaging portion 35 deviates from the center O2 of the connection needle 1*a* toward the open surface of the container body 5 by a distance L.

In addition, the eccentricity between the rotation center O1 and the center O2 is set such that, as shown in FIGS. 7 and 8, when the container engaging portion 35 of the residual amount detecting unit 11 is engaged with the detecting unit engaging portion 23 of the container body 5 and the residual amount detecting unit 11 is rotated to engage the locking piece 38 with the locking groove 24, the connection needle 11*a* is positioned substantially at the center of the connection port 7*a* of the ink pack 7 accommodated in the pouch accommodating portion 3 of the container body 5.

That is, when the residual amount detecting unit 11 is engaged with the container body 5, the connection needle 11*a* is disposed at an eccentric position that deviates from the center of the opening 18 formed in the partition wall 5*a*. When the residual amount detecting unit 11 is coupled to the container body 5, the connection needle 11*a* is disposed at the center of the opening 18. Therefore, the residual amount detecting unit 11 is formed so as to move between the eccentric position and the central position when the residual amount detecting unit 11 is rotated. As a result, the residual amount detecting unit 11 rotates in a narrow rotation range.

According to the ink cartridge 1 of the first embodiment, since the liquid delivery portion 9 is provided at a position close to the positioning hole 27 that is formed in the front wall 5*c*, it is possible to reduce the influence of an increase in the tolerances between the positioning pins 106 and 107 of the cartridge mounting portion 100 and the positioning holes 27 and 28 of the container body 5, which are more likely to occur due to an increase in the size of the ink cartridge. Therefore, it is possible to improve the positional accuracy between the liquid supply portion 102 of the cartridge mounting portion 100 and the liquid delivery portion 9 of the container body 5, and smoothly connect the liquid supply portion 102 and the liquid delivery portion 9. As a result, it is possible to prevent the deterioration of the mountability of the ink cartridge 1.

Further, in the ink cartridge 1 according to this embodiment, the liquid delivery portion 9 is provided at a position that deviates from the center line S of the connection port 7*a* of the ink pack 7. A passage extending in the width direction of the container body 5 is formed between the connection port 7*a* and the liquid delivery portion 9. Therefore, it is possible to provide the residual amount detecting unit 11, serving as an additional function unit, in a portion of the passage while minimizing the length of the container body 5 in the longitudinal direction (lengthwise direction) thereof. As a result, it is possible to form a small ink cartridge 1 provided with the residual amount detecting unit 11.

Furthermore, the ink cartridge 1 according to this embodiment includes the residual amount detecting unit 11, serving as an offset passage member having a passage that communicates between the connection port 7*a* of the ink pack 7 and the liquid delivery portion 9, and the detecting unit engaging portion 23 that is provided in a connecting portion between the container body 5 and the residual amount detecting unit 11 to enable the residual amount detecting unit 11 to be rotatably engaged with or disengaged from the container body 5. The use of the residual amount detecting unit 11, serving as the offset passage member, makes it easy to provide the liquid delivery portion 9 at a position that deviates from the center line S of the connection port 7*a*, which results in an increase in the flexibility of the position where the liquid delivery portion 9 is formed.

Further, in the ink cartridge 1 according to this embodiment, the liquid delivery portion 9 is provided at a position close to the positioning hole 27 that is formed in the front wall 5*c*, and the circuit board 31 is provided on the upper wall 5*d* of the container body so as to be close to the positioning hole 27 that is formed in the front wall 5*c*. Therefore, it is possible to ensure good electrical connection between the circuit board 31 and the connection terminals 109 formed on the cartridge mounting portion 100 when the ink cartridge 1 is mounted to the cartridge mounting portion 100.

As shown in FIGS. 5 and 6, when the container engaging portion 35 of the residual amount detecting unit 11 is engaged with the detecting unit engaging portion 23 of the container body 5 and then the residual amount detecting unit 11 is rotated in the direction of the arrow (B) shown in FIG. 5 in the vicinity of the engaging portion, the locking piece 38 that protrudes from the outer circumferential surface of the container engaging portion 35 is engaged with the locking groove 24 of the container body 5, and the engaging portion 39 is engaged with the engaging portion of the container body 5, thereby fixing the residual amount detecting unit 11 to the container body 5.

That is, the residual amount detecting unit 11 is attached to the container body 5 having the ink pack 7 accommodated therein by a simple operation of engaging the engaging portions 35 and 23 that are provided in a connecting portion between the residual amount detecting unit 11 and the container body 5 and rotating the residual amount detecting unit 11. Therefore, it is possible to easily assemble the ink cartridge 1 and thus improve the productivity of the ink cartridge 1.

Further, since the rotation center O1 of the container engaging portion 35 deviates from the center O2 of the connection needle 11*a*, it is possible to reduce the rotation locus of the locking piece 38 of the residual amount detecting unit 11 that is engaged with the container body 5 by rotation. Therefore, it is possible to form the locking groove 24 of the container body 5 at a position close to the rotation center of the residual amount detecting unit 11, or reduce the depth of the locking groove 24. As a result, it is possible to reduce the size of the container body 5 and thus prevent an increase in the size of the ink cartridge 1.

Furthermore, in the ink cartridge 1 according to this embodiment, the container engaging portion 35 of the residual amount detecting unit 11 is engaged with the detecting unit engaging portion 23 of the container body 5 and then the residual mount detecting unit 11 is rotated to fit the locking piece 38 into the locking groove 24. In this case, as shown in FIG. 8, the connection needle 11*a* is positioned substantially at the center of the connection port 7*a* of the ink pack 7 that is accommodated in the pouch accommodating portion 3 of the container body 5.

Therefore, as shown in FIG. 7, when a manufacturing method of rotating the residual amount detecting unit 11 to be fixed to the container body 5 and setting the ink pack 7 in the pouch accommodating portion 3 of the container body 5 is adopted, it is possible to simply align the connection port 7*a* of the ink pack 7 with the connection needle 11*a* of the residual amount detecting unit 11. As a result, it is possible to easily connect the residual amount detecting unit 11 and the ink pack 7, and thus improve the assembly of an ink cartridge.

Furthermore, in the ink cartridge 1 according to this embodiment, both the detecting unit engaging portion 23 of the container body 5 and the container engaging portion 35 of the residual amount detecting unit 11 include one or more convex walls, and they are rotatably engaged with each other by the ring structures of the convex walls. Since the convex walls are intermittently provided, it is possible to improve die cutting during molding and thus easily manufacture the detecting unit engaging portion 23 and the container engaging portion 35, as compared to a cylindrical structure in which the detecting unit engaging portion 23 and the container engaging portion 35 are engaged with each other.

The detailed structure of the detecting unit engaging portion 23 or the container engaging portion 35 is not limited to the above-described embodiment. In this embodiment, the detecting unit engaging portion 23 or the container engaging portion 35 includes two convex walls, but the invention is not limited thereto. The detecting unit engaging portion 23 or the container engaging portion 35 may include one convex wall or three or more convex walls forming a ring structure for regulating the rotation center. In addition, instead of the convex walls, one or more concave grooves may be used to form a ring structure for regulating the rotation center.

Moreover, in the ink cartridge 1 according to the first embodiment, when the container mounted to the cartridge mounting portion 100 of the ink jet printing apparatus is used, the liquid delivery portion 9 is positioned above the center of the front wall 5*c* (the center line S of the connection port 7*a*) in the height direction during the use of the container.

Therefore, in general, during the use of the container, the liquid delivery portion 9 of the container body 5 is positioned above the connection port 7*a* of the ink pack 7 that is disposed at a height substantially equal to the center of the front wall 5*c* of the container body 5. Therefore, it is possible to reduce the static pressure of the liquid delivery portion 9 by a value corresponding to the water head difference thereof, and thus reduce the leakage of ink from the liquid delivery portion 9. That is, an ink passage from the connection port 7*a* rises from the connection port 7*a* to the liquid delivery portion 9 in the vertical direction. In the ink passage, since the weight of ink is subtracted from the pressure of ink, the pressure of ink applied to the liquid delivery portion 9 is reduced.

In the ink cartridge 1 according to the first embodiment, the internal passage of the residual amount detecting unit 11 extends in the width direction (in the direction of an arrow X in FIG. 2) of the container body 5 between the connection port 7*a* and the liquid delivery port 9, and the residual amount detecting unit 11, serving as an additional function unit, is provided in a portion of the passage. However, the additional function unit according to the invention is not limited thereto.

Figure 11:
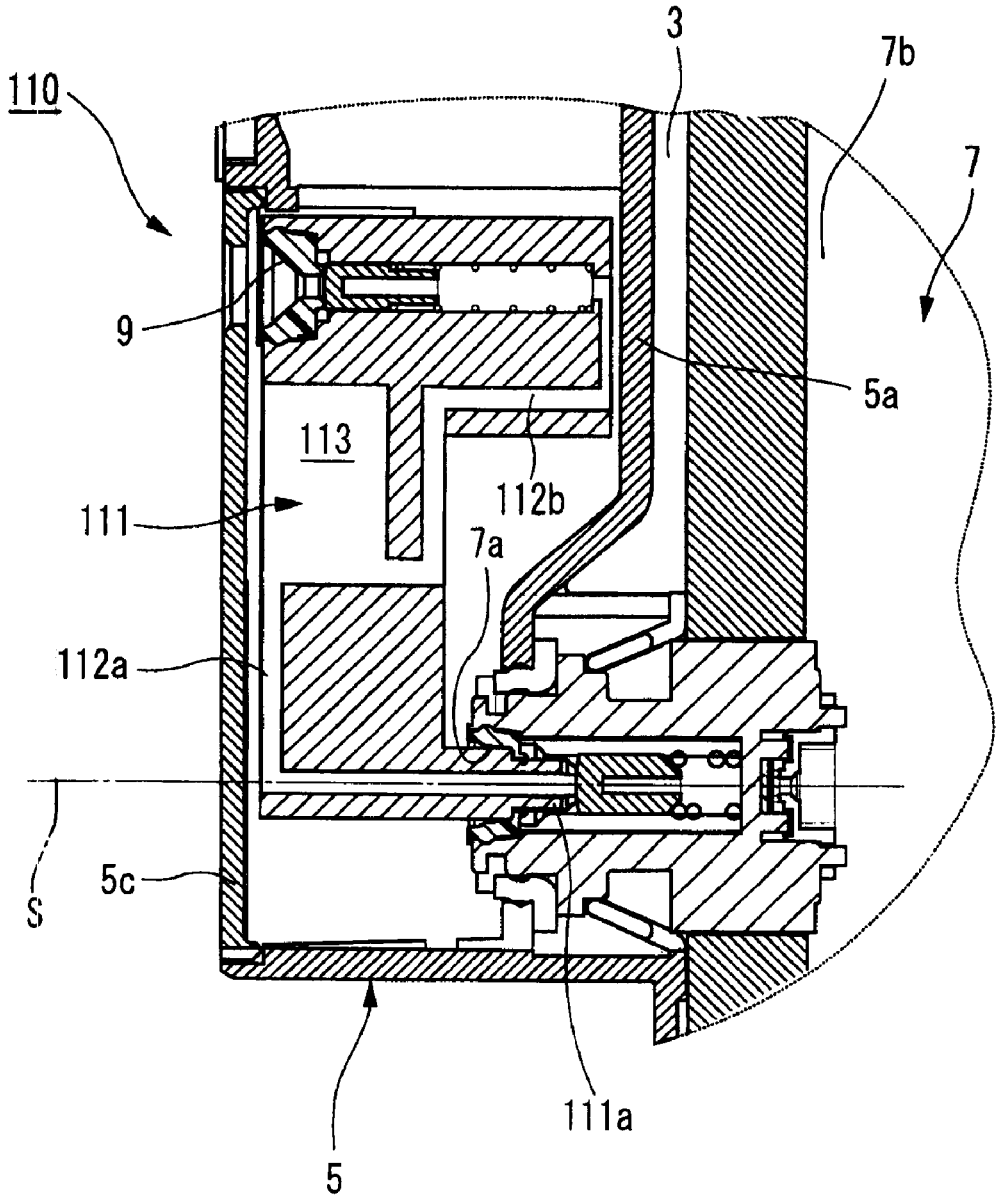
FIG. 11 is an enlarged cross-sectional view illustrating main parts of a liquid container according to a second embodiment of the invention.

For example, an ink cartridge 110 shown in FIG. 11 according to a second embodiment is a liquid container having an air bubble trap unit 111, serving as an additional function unit, provided between the connection port 7*a* and the liquid delivery portion 9, instead of the residual amount detecting unit 11 of the ink cartridge 1 according to the first embodiment. In the second embodiment, components having the same structures as those of the ink cartridge 1 according to the first embodiment are denoted by the same reference numerals, and a detailed description thereof will be omitted.

As shown in FIG. 11, in the ink cartridge 110, internal passages 112*a* and 112*b* and a trap chamber 113 extend in the width direction (in the vertical direction of FIG. 11) of the container body 5 between the connection port 7*a* and the liquid delivery port 9, and the air bubble trap unit 111, serving as an additional function unit, is provided in a portion of the passage.

In this way, air bubbles in the ink contained in the ink pack 7 and the internal passage 112*a* are prevented from being supplied from the liquid delivery portion 9 to the printing head together with the ink, which makes it possible to maintain a high printing quality of the printing head. That is, even when air bubbles are generated from the ink contained in the ink pack 7 and the internal passage 112*a* due to the outside air infiltrated into the flexible pouch 7*b* of the ink pack 7 or deaerated ink flowing back from the liquid delivery portion 9, the air bubbles in the passage are captured in the trap chamber 113 and no air bubble flows from the internal passage 112 to the liquid delivery portion 9.

Therefore, in the ink cartridges 1 and 110 according to the first and second embodiments, the liquid delivery portion 9 is provided at a position that deviates from the center line S of the connection port 7*a*, and a passage extends in the width direction of the container body 5 between the connection port 7*a* and the liquid delivery portion 9. Therefore, it is possible to provide the residual amount detecting unit 11 or the air bubble trap unit 111 having a small size, serving as an additional function unit, in a portion of the passage while minimizing the length of the container body 5 in the longitudinal direction thereof.

Figure 12B:
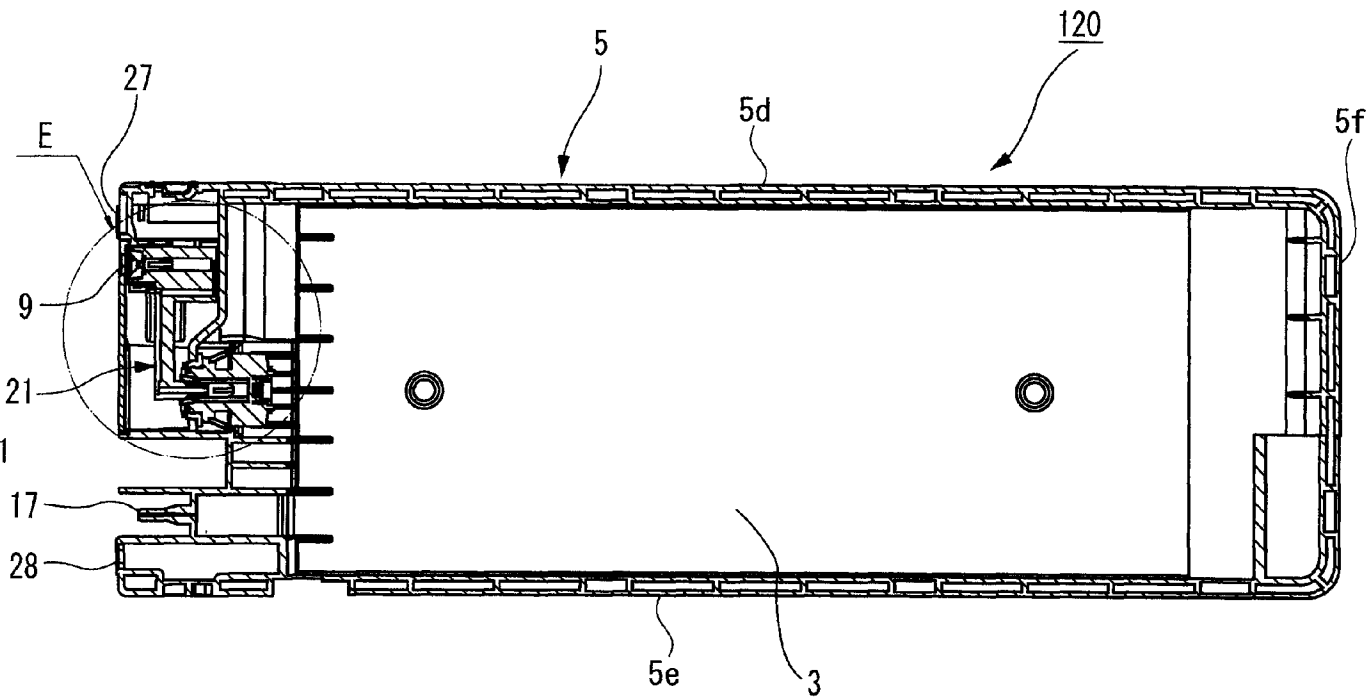
FIG. 12B is a cross-sectional view taken along the line D-D of FIG. 12A.
Figure 12A:
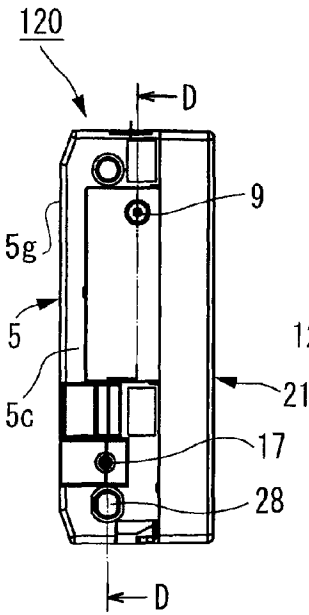
FIG. 12A is a front view illustrating a liquid container according to a third embodiment of the invention.
Figure 13:
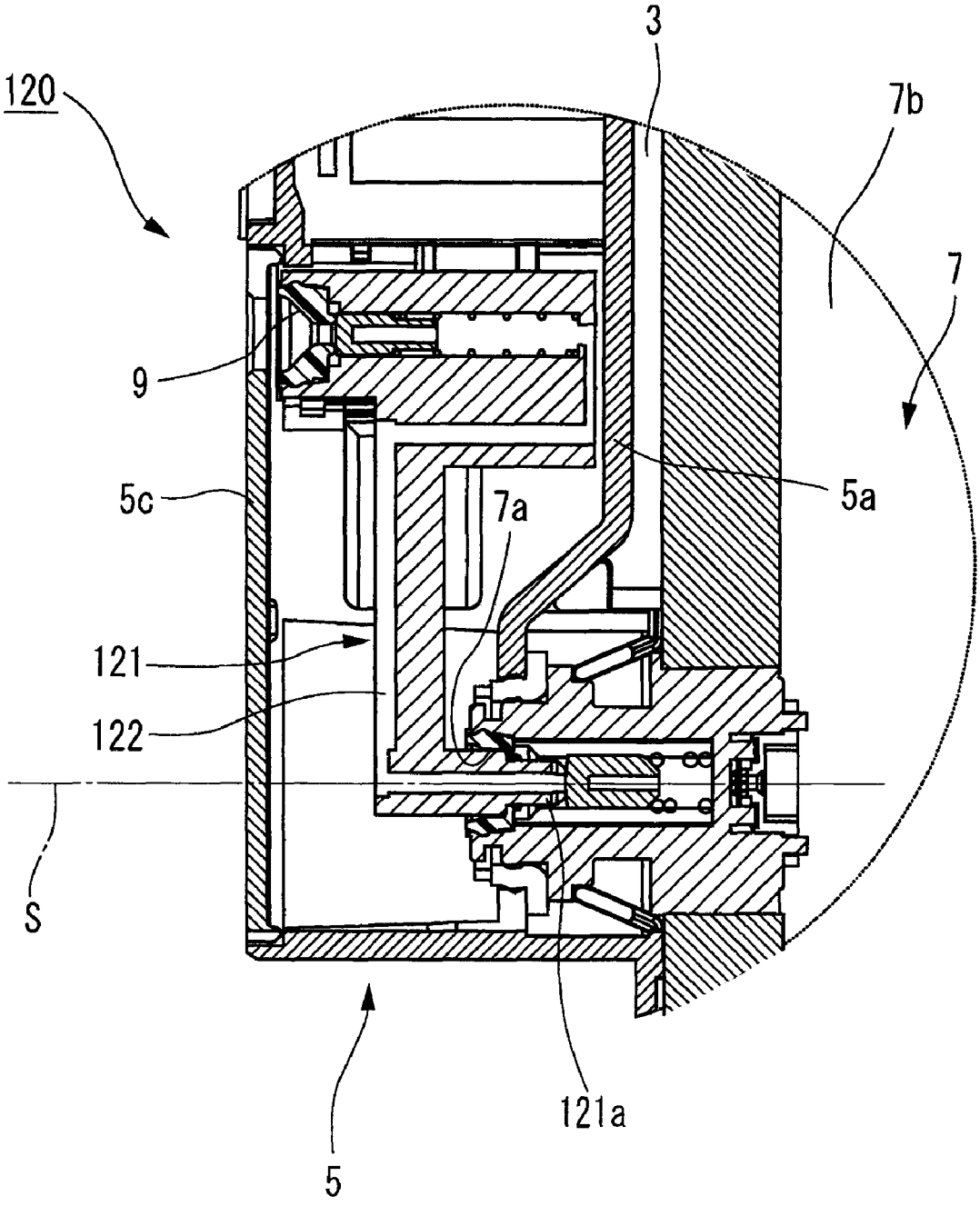
FIG. 13 is an enlarged view illustrating a portion E of FIG. 12B.

In an ink cartridge 120 according to a third embodiment shown in FIGS. 12 and 13, instead of the residual amount detecting unit 11 of the ink cartridge 1 according to the first embodiment, an offset passage member 121 is detachably mounted to the container body 5. In the third embodiment, components having the same structures as those of the ink cartridge 1 according to the first embodiment are denoted by the same reference numerals, and a detailed description thereof will be omitted.

As shown in FIG. 13, in the ink cartridge 120, a passage 122 of the offset passage member 121 extends in the width direction (in the vertical direction of FIG. 13) of the container body 5 between the connection port 7*a* of the ink pack 7 and the liquid delivery portion 9.

The offset passage member 121 has an engaging means that enables the offset passage member 121 to be attached to or detached from the container body 5 by rotation in a connecting portion with the container body 5, similar to the detecting unit engaging portion 23 of the first embodiment.

That is, in the ink cartridge 120 according to the third embodiment, the use of the offset passage member 121 makes it easy to provide the liquid delivery portion 9 at a position that deviates from the center line S of the connection port 7*a*. As a result, the flexibility of the position where the liquid delivery portion 9 is formed is improved.

Similar to the ink cartridge 1 according to the first embodiment, in the ink cartridge 120 according to the third embodiment, the liquid delivery portion 9 is provided at a position close to the positioning hole 27 that is formed in the front wall 5*c*. Therefore, it is possible to reduce the influence of an increase in the tolerances between the positioning pins 106 and 107 of the cartridge mounting portion 100 and the positioning holes 27 and 28 of the container body 5, which are more likely to occur due to an increase in the size of the ink cartridge. Thus, it is possible to improve the positional accuracy between the liquid supply portion 102 of the cartridge mounting portion 100 and the liquid delivery portion 9 of the container body 5, and smoothly connect the liquid supply portion 102 and the liquid delivery portion 9. As a result, it is possible to prevent the deterioration of the mountability of the ink cartridge 120.

In the ink cartridge 120 according to the third embodiment, when the container mounted to the cartridge mounting portion 100 of the ink jet printing apparatus is used, the liquid delivery portion 9 is positioned above the center of the front wall 5*c* (the center line S of the connection port 7*a*) in the height direction during the use of the container. Therefore, in general, during the use of the container, the liquid delivery portion 9 of the container body 5 is positioned above the connection port 7*a* of the ink pack 7 that is disposed substantially at the center of the front wall 5*c* of the container body 5. Therefore, it is possible to reduce the static pressure of the liquid delivery portion 9 by a value corresponding to the water head difference thereof, and thus reduce the leakage of ink from the liquid delivery portion 9.

Figure 14:
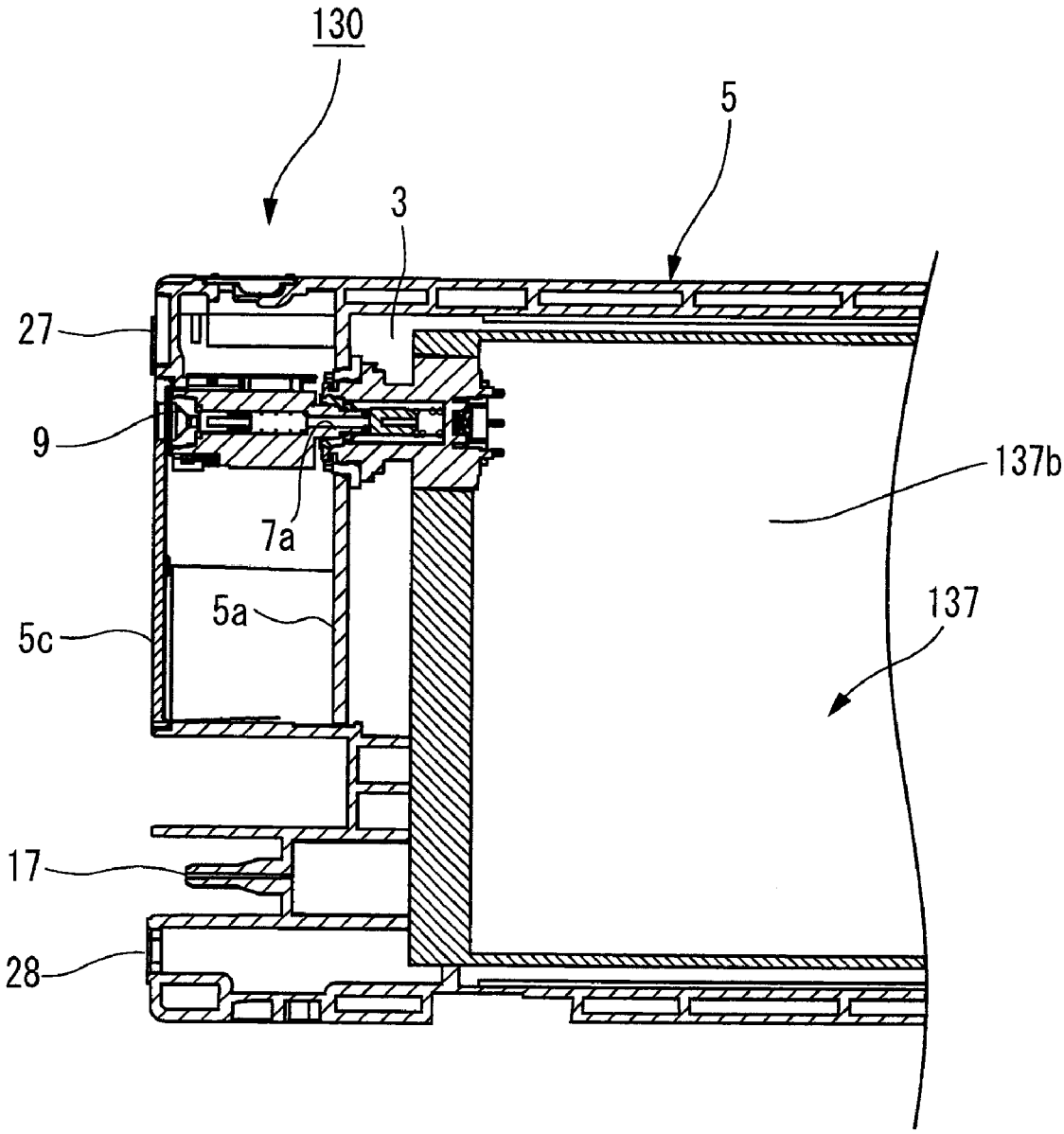
FIG. 14 is an enlarged cross-sectional view illustrating main parts of a liquid container according to a fourth embodiment of the invention.
Figure 15:
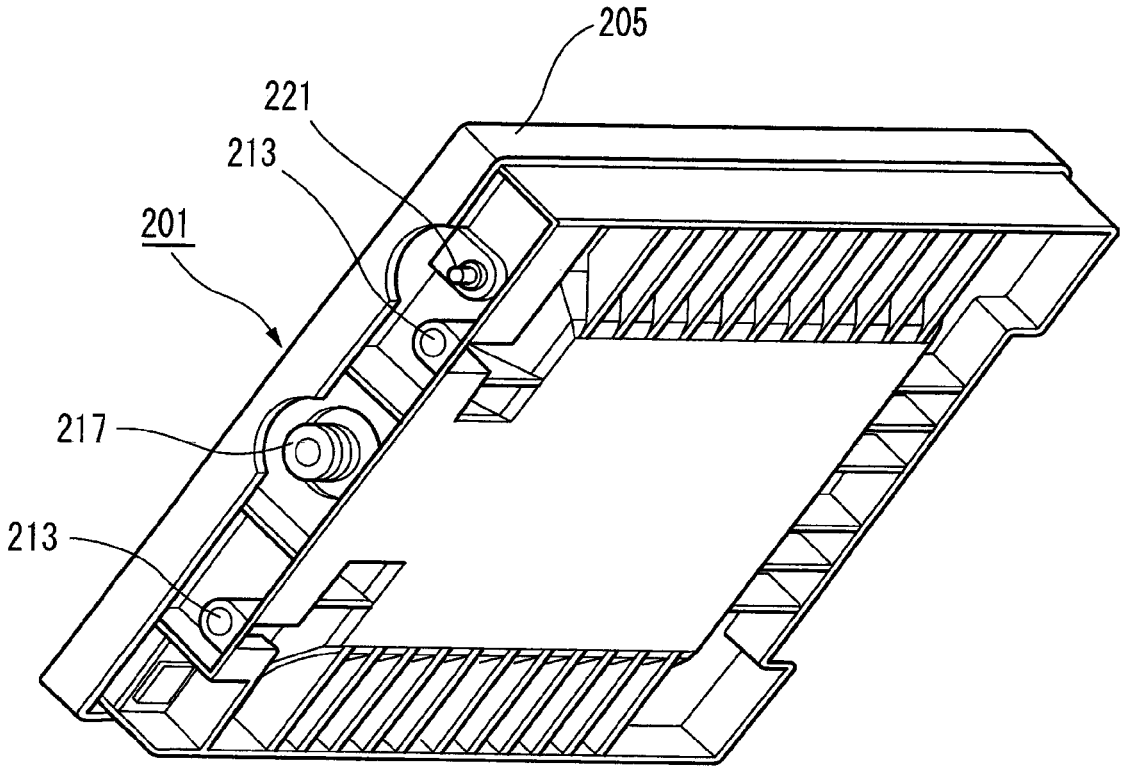
FIG. 15 is a perspective view illustrating a liquid container according to the related art.
Figure 16:
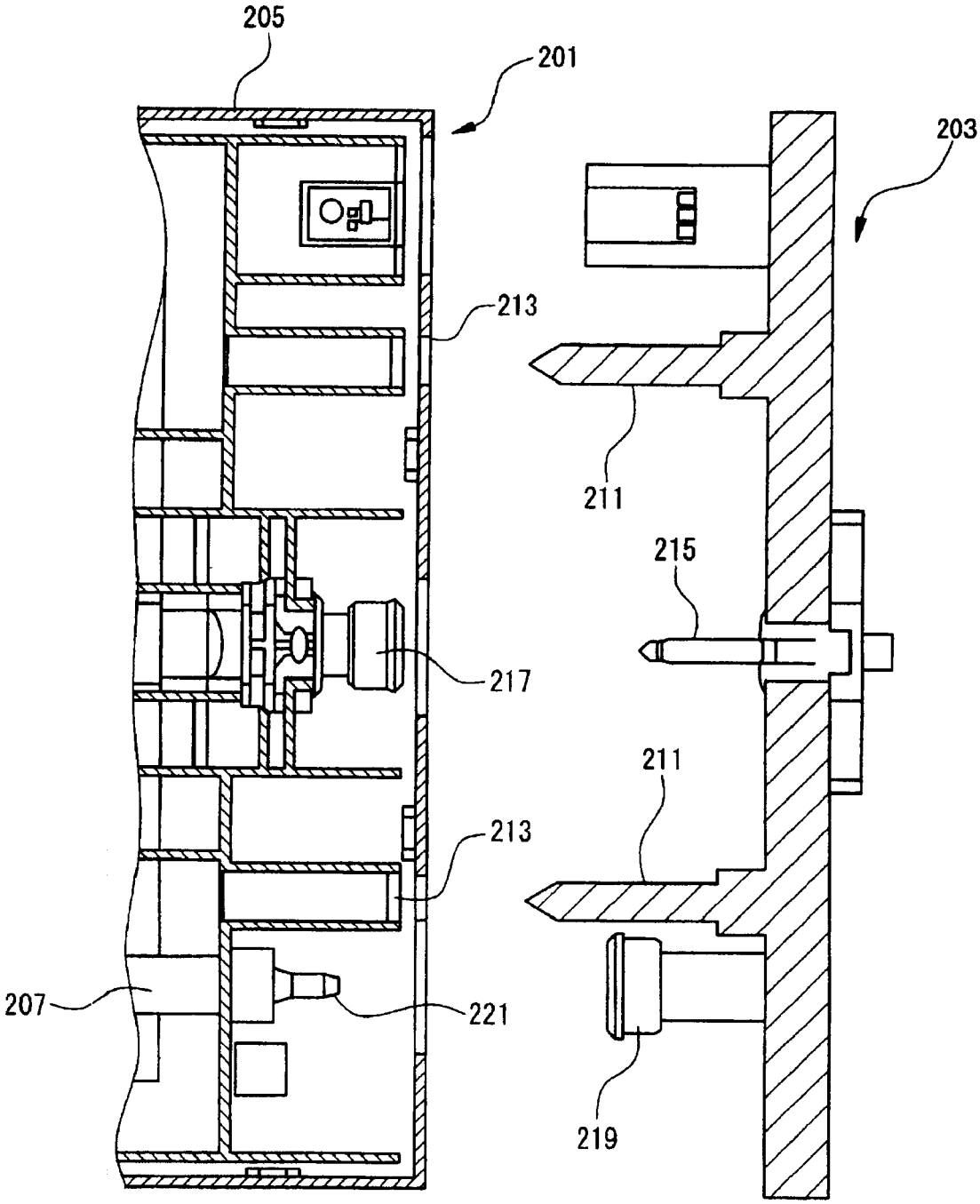
FIG. 16 is a cross-sectional view illustrating main parts of a liquid mounting portion and the liquid container shown in FIG. 15.
Figure 17:
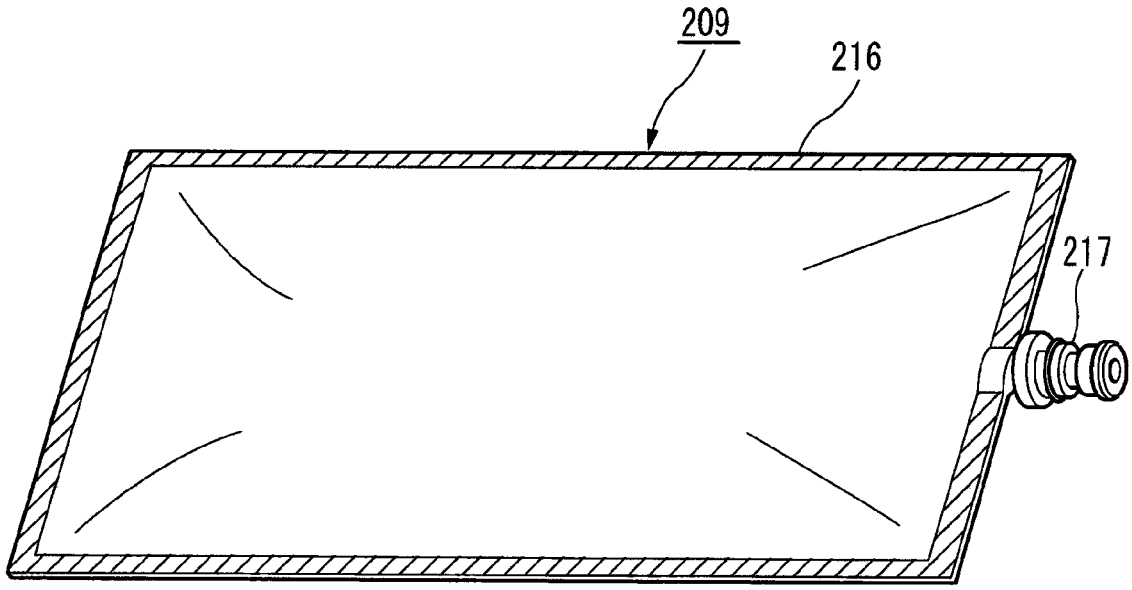
FIG. 17 is a perspective view illustrating an ink pack accommodated in the liquid container shown in FIG. 15.

FIG. 14 is a cross-sectional view illustrating main parts of a liquid container according to a fourth embodiment of the invention. In the fourth embodiment, components having the same structures as those of the ink cartridge 1 according to the first embodiment are denoted by the same reference numerals, and a detailed description thereof will be omitted.

An ink cartridge 130 according to the fourth embodiment includes: a container body 5 that is detachably mounted to a cartridge mounting portion 100 and supplies ink (liquid) stored in an ink pack 137, serving as a liquid containing portion, to a printing head provided in a printing apparatus; a connection port 7*a* which delivers ink contained in the ink pack 137; a liquid delivery portion 9 which is provided in a front wall 5*c*, which is a lead end surface of the container body 5 in the direction in which the container body 5 is mounted, and through which a liquid supply portion 102 provided in the cartridge mounting portion 100 communicates with the connection port 7*a*; and two positioning holes 27 and 28 into which two positioning pins 106 and 107 provided on the container mounting portion 100 at positions facing the front wall 5*c* are fitted, thereby regulating movement along the front wall 5*c*.

In the ink pack 137 of the ink cartridge 130, the connection port 7*a* that discharges ink stored in the ink pack by pressure applied to the pouch accommodating portion 3 is provided in one side of a flexible pouch 7*b* so as to be offset to one corner (an upper corner in FIG. 14).

Meanwhile, the liquid delivery portion 9 through which the liquid supply portion 102 of the cartridge mounting portion 100 communicates with the connection port 7*a* is provided at a position close to the positioning hole 27 of the two positioning holes 27 and 28 that are formed at both sides of the front wall 5*c* in the width direction thereof.

Therefore, the liquid delivery portion 9 and the connection port 7*a* of the ink pack 137 are provided at an offset position that deviates from the center of the front wall 5*c* in the upward direction of FIG. 14 such that the center lines thereof are substantially aligned with each other.

As shown in FIG. 14, when the ink cartridge 130 is actually inserted into an ink jet printing apparatus, the liquid delivery portion 9 is provided above the center of the front wall 5*c* in the height direction when the container is used.

Therefore, according to the ink cartridge 130 of the fourth embodiment, the liquid delivery portion 9 is provided at a position close to the positioning hole 27 that is formed in the front wall 5*c*. Therefore, it is possible to reduce the influence of an increase in the tolerances between the positioning pins 106 and 107 of the cartridge mounting portion 100 and the positioning holes 27 and 28 of the container body 5, which are more likely to occur due to an increase in the size of the ink cartridge. Thus, it is possible to improve the positional accuracy between the liquid supply portion 102 of the cartridge mounting portion 100 and the liquid delivery portion 9 of the container body 5, and smoothly connect the liquid supply portion 102 and the liquid delivery portion 9. As a result, it is possible to prevent the deterioration of the mountability of the ink cartridge 130.

Further, in the ink cartridge 130 according to the fourth embodiment, when the container mounted to the cartridge mounting portion 100 of the ink jet printing apparatus is used, the connection port 7*a* and the liquid delivery portion 9 are positioned above the center of the front wall 5*c* in the height direction during the use of the container. Therefore, it is possible to reduce the pressure of ink applied to the liquid delivery portion 9 through the connection port 7*a* due to the weight of ink contained in the ink pack 137, and thus reduce the leakage of ink from the liquid delivery portion 9.

As shown in FIG. 2, positioning holes 27 and 28 into which positioning pins 106 and 107 provided on the cartridge mounting portion 100 are inserted respectively when the ink cartridge 1 is mounted to the cartridge mounting portion 100, are provided at both sides of the front wall 5*c* (see FIG. 10). The positioning hole 27 is formed in a circular shape, and the positioning hole 28 is formed in a shape that is elongated in the width direction (in the direction of an arrow X in FIG. 2) of the container body 5. The elongated positioning hole 28 makes it possible to improve positioning accuracy and easily allow a tolerance.

In addition, the number of positioning holes and the number of positioning holes are preferably two or more. When two or more positioning holes are provided, the liquid delivery portion may be provided close to any one of the plurality of positioning holes.

Furthermore, the use of the liquid container according to the invention is not limited to an ink cartridge of an ink jet printing apparatus. The liquid container according to the invention may be used for various types of liquid consuming apparatuses provided with liquid ejecting heads.

The liquid consuming apparatuses provided with liquid ejecting heads include, for example, apparatuses provided with color material ejecting heads used to manufacture color filters, such as liquid crystal displays, apparatuses provided with electrode material (conductive paste) ejecting heads used to manufacture electrodes of, for example, organic EL displays and surface-emitting displays (FEDs), apparatuses provided with bio-organic material ejecting heads used to manufacture bio chips, apparatuses provided with sample ejecting heads, such as accurate pipettes, and printing apparatuses or micro-dispensers.

This application claims priority from Japanese Patent Application Nos. 2006-300935 filed on Nov. 6, 2006, 2007-240195 filed on Sep. 14, 2007 and 2007-094151 filed on Mar. 30, 2007, the entire disclosure of which are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. A liquid container that is detachably mounted to a container mounting portion of a liquid consuming apparatus, the liquid consuming apparatus having first and second positioning pins, comprising:

a liquid containing portion that stores a liquid;

a front wall having a substantially rectangle shape including first and second shorter sides opposite to each other;

a first side wall intersecting with the first shorter side of the front wall;

a second side wall intersecting with the second shorter side of the front wall;

a first hole provided at the position adjacent to the first shorter side in the front wall, the first hole receiving the first positioning pin of the liquid consuming apparatus;

a second hole provided at the position adjacent to the second shorter side in the front wall, the second hole receiving the second positioning pin of the liquid consuming apparatus; and a liquid delivery portion which is provided in the front wall of the liquid container and supplies the liquid to the liquid consuming apparatus, the liquid delivery portion provided adjacent to the first hole; and a passage connecting the liquid containing portion and the liquid delivery portion, wherein the liquid containing portion includes a connection port connected to the passage and the liquid delivery portion is provided at a position deviating from a center line of an opening of the connection port.

2. The liquid container according to claim 1, wherein the first hole is positioned above the second hole when the liquid container is mounted to the liquid consuming apparatus.

3. The liquid container according to claim 1, further comprising:

a circuit board providing on the first side wall and adapted to be connected to a connection terminal of the liquid consuming apparatus.

4. The liquid container according to claim 1, further comprising a port supplying a pressurized air to the liquid containing portion, the port provided adjacent to the second hole.

5. The liquid container according to claim 1, wherein the first side wall is disposed upper than the second side wall when the liquid container is mounted to the liquid consuming apparatus.

6. The liquid container according to claim 1, further comprising:

a container body including the liquid containing portion, the front wall, the first and second side walls, and the first and the second holes; and an offset passage member including the liquid delivery portion and having a passage connecting the liquid containing portion and the liquid delivery portion, the offset passage member detachably engaged with the container body.

7. The liquid container according to claim 6, wherein the liquid containing portion including a connection port connected to the passage.

8. The liquid container according to claim 7, wherein the liquid delivery portion is provided at a position deviating from a center line of an opening of the connection port.

9. The liquid container according to claim 6, further comprising a port supplying a pressurized air to the liquid containing portion, the port provided adjacent to the second hole.

10. The liquid container according to claim 6, wherein the first side wall is disposed upper than the second side wall when the liquid container is mounted to the liquid consuming apparatus.

11. The liquid container according to claim 1, further comprising a port supplying a pressurized air to the liquid containing portion, the port provided adjacent to the second hole.

12. The liquid container according to claim 1, wherein the first side wall is disposed upper than the second side wall when the liquid container is mounted to the liquid consuming apparatus.

13. The liquid container according to claim 1, wherein the first hole is formed in a circular shape, and the second hole is formed in a shape elongated in a longitudinal direction of the front wall.

14. The liquid container according to claim 1 wherein both the first and second shorter sides and the first and second longer sides have a substantially shorter length than the length of the first and second side walls when the length of the first and second side walls is measured along the direction in which the liquid container is mounted to the liquid consuming apparatus.

15. A liquid container that is detachably mounted to a container mounting portion of a liquid consuming apparatus, the liquid consuming apparatus having first and second positioning pins, comprising:

a liquid containing portion that stores a liquid;

a front wall having a substantially rectangle shape including first and second shorter sides opposite to each other and first and second longer sides opposite to each other;

a first side wall intersecting with the first shorter side of the front wall;

a second side wall intersecting with the second shorter side of the front wall;

a first hole provided at the position adjacent to the first shorter side in the front wall, the first hole receiving the first positioning pin of the liquid consuming apparatus;

a second hole provided at the position adjacent to the second shorter side in the front wall, the second hole receiving the second positioning pin of the liquid consuming apparatus; and a liquid delivery portion which consists of a single liquid delivery port provided in the front wall of the liquid container that supplies the liquid to the liquid consuming apparatus, the single liquid delivery port provided adjacent to the first hole wherein the liquid containing portion and the single liquid delivery port are constructed and adapted so that all of the liquid supplied to the liquid consuming apparatus by the liquid container is supplied through the single liquid delivery port.

16. The liquid container according to claim 15, wherein the first hole is positioned above the second hole when the liquid container is mounted to the liquid consuming apparatus.

17. The liquid container according to claim 15, further comprising:

a circuit board providing on the first side wall and adapted to be connected to a connection terminal of the liquid consuming apparatus.

18. The liquid container according to claim 15, further comprising a passage connecting the liquid containing portion and the liquid delivery portion.

19. The liquid container according to claim 18, wherein the liquid containing portion includes a connection port connected to the passage.

20. The liquid container according to claim 19, wherein the liquid delivery portion is provided at a position deviating from a center line of an opening of the connection port.

21. The liquid container according to claim 18, further comprising a port supplying a pressurized air to the liquid containing portion, the port provided adjacent to the second hole.

22. The liquid container according to claim 18, wherein the first side wall is disposed upper than the second side wall when the liquid container is mounted to the liquid consuming apparatus.

23. The liquid container according to claim 15, further comprising:

a container body including the liquid containing portion, the front wall, the first and second side walls, and the first and the second holes; and an offset passage member including the liquid delivery portion and having a passage connecting the liquid containing portion and the liquid delivery portion, the offset passage member detachably engaged with the container body.

24. The liquid container according to claim 23, wherein the liquid containing portion including a connection port connected to the passage.

25. The liquid container according to claim 24, wherein the liquid delivery portion is provided at a position deviating from a center line of an opening of the connection port.

26. The liquid container according to claim 23, further comprising a port supplying a pressurized air to the liquid containing portion, the port provided adjacent to the second hole.

27. The liquid container according to claim 23, wherein the first side wall is disposed upper than the second side wall when the liquid container is mounted to the liquid consuming apparatus.

28. The liquid container according to claim 15, further comprising a port supplying a pressurized air to the liquid containing portion, the port provided adjacent to the second hole.

29. The liquid container according to claim 15, wherein the first side wall is disposed upper than the second side wall when the liquid container is mounted to the liquid consuming apparatus.

30. The liquid container according to claim 15, wherein the first hole is formed in a circular shape, and the second hole is formed in a shape elongated in a longitudinal direction of the front wall.

31. The liquid container according to claim 15 wherein both the first and second shorter sides and the first and second longer sides have a substantially shorter length than the length of the first and second side walls when the length of the first and second side walls is measured along the direction in which the liquid container is mounted to the liquid consuming apparatus.

* * * * *